US012421957B2

(12) United States Patent
Noh

(10) Patent No.: US 12,421,957 B2
(45) Date of Patent: Sep. 23, 2025

(54) ELASTIC BODY AND LINEAR COMPRESSOR INCLUDING THE SAME

(71) Applicant: LG ELECTRONICS INC., Seoul (KR)

(72) Inventor: Kiwon Noh, Seoul (KR)

(73) Assignee: LG Electronics Inc., Seoul (KR)

( * ) Notice: Subject to any disclaimer, the term of this patent is extended or adjusted under 35 U.S.C. 154(b) by 513 days.

(21) Appl. No.: 17/514,533

(22) Filed: Oct. 29, 2021

(65) Prior Publication Data

US 2022/0196010 A1 Jun. 23, 2022

(30) Foreign Application Priority Data

Dec. 18, 2020 (KR) ..... 10-2020-0178607

(51) Int. Cl.
*F04B 53/00* (2006.01)
*F04B 39/00* (2006.01)
*F04B 39/12* (2006.01)

(52) U.S. Cl.
CPC ..... *F04B 53/003* (2013.01); *F04B 39/0022* (2013.01); *F04B 39/121* (2013.01); *F04B 39/127* (2013.01)

(58) Field of Classification Search
CPC ..... F16F 1/326; F04B 53/003; F04B 39/0022; F04B 39/121; F04B 39/127; F04B 35/045;
(Continued)

(56) References Cited

U.S. PATENT DOCUMENTS 5,492,313 A * 2/1996 Pan ..... F16F 1/025 60/520
5,522,214 A * 6/1996 Beckett ..... F02G 1/053 92/84
(Continued)

FOREIGN PATENT DOCUMENTS

CN 101501338 8/2009
CN 105275776 1/2016
(Continued)

OTHER PUBLICATIONS

Extended European Search Report in European Appln. No. 21191088.0, dated Jan. 5, 2022, 9 pages.
(Continued)

*Primary Examiner* — Mark A Laurenzi
*Assistant Examiner* — Benjamin Doyle
(74) *Attorney, Agent, or Firm* — Fish & Richardson P.C.

(57) ABSTRACT

An elastic body and a linear compressor including the elastic body are provided. The elastic body according to an aspect of the present disclosure includes a plurality of elastic units disposed circumferentially around an axis, each of the plurality of elastic units has a corresponding shape, each of the plurality of elastic units includes an elastic portion that is spirally formed while moving away from the axis, an outer portion disposed on an outside of the elastic portion in a radial direction thereof, and an inner portion disposed on an inside of the elastic portion in the radial direction thereof, the outer portion is adjacent to the outer portion of an adjacent elastic unit, the inner portion is adjacent to the inner portion of the adjacent elastic unit, and a slit is formed between the plurality of elastic portions.

17 Claims, 18 Drawing Sheets

(58) Field of Classification Search
CPC .. F04B 35/04; F04B 39/0044; F04B 39/0005; F04B 39/12; F05B 2210/14; F05B 2260/502
USPC ..... 267/161–163; 417/363
See application file for complete search history.

(56) References Cited

U.S. PATENT DOCUMENTS 5,895,033 A * 4/1999 Ross ..... F16F 7/116 60/520
5,920,133 A * 7/1999 Penswick ..... F02G 1/043 310/15
5,993,178 A * 11/1999 Park ..... F04B 35/045 417/416
6,050,556 A * 4/2000 Masuda ..... F16D 3/52 267/161
6,056,519 A * 5/2000 Morita ..... F04B 39/0027 417/415
6,127,750 A * 10/2000 Dadd ..... F04B 35/045 310/27
6,129,527 A * 10/2000 Donahoe ..... F04B 35/045 417/418
6,371,464 B1 * 4/2002 Porche ..... F16F 1/08 604/9
6,565,332 B2 * 5/2003 Kawahara ..... F04B 35/045 417/363
6,641,377 B2 * 11/2003 Toyama ..... F04B 35/045 417/419
7,367,786 B2 * 5/2008 Kang ..... F04B 35/045 417/417
8,678,782 B2 * 3/2014 Williams ..... F04B 35/045 417/363
8,960,655 B2 * 2/2015 Wood ..... F02G 1/0435 267/159
8,998,589 B2 * 4/2015 Lilie ..... F04B 35/045 417/415
9,810,278 B2 * 11/2017 Huang ..... F16F 1/027
11,021,238 B2 * 6/2021 Zoolakis ..... G01D 5/2291
11,530,695 B1 * 12/2022 Hahn ..... F04B 39/0027
2003/0017064 A1 * 1/2003 Kawahara ..... F04B 39/127 417/417
2005/0135946 A1 6/2005 Kang et al.
2012/0160091 A1 * 6/2012 Dadd ..... F16F 1/027 92/132

FOREIGN PATENT DOCUMENTS

| | | |
|---|---|---|
| CN | 105298795 | 2/2016 |
| CN | 107304759 | 10/2017 |
| CN | 107339209 | 11/2017 |
| CN | 108425827 | 8/2018 |
| CN | 110725786 | 1/2020 |
| EP | 1450472 | 8/2004 |
| EP | 2975267 | 1/2016 |
| EP | 3244064 | 11/2017 |
| JP | 11324914 | 11/1999 |
| KR | 19990002719 | 1/1999 |
| KR | 20030042815 | 6/2003 |
| KR | 1020050031777 | 4/2005 |
| KR | 20170124900 | 11/2017 |
| KR | 20170124904 | 11/2017 |

OTHER PUBLICATIONS

Notice of Allowance in Korean Appln. No. 10-2020-0178607, dated Jul. 19, 2022, 4 pages (with English translation).
Office Action in Chinese Appln. No. 202111174784.6, mailed on Mar. 31, 2023, 14 pages(with English translation).

* cited by examiner

ELASTIC BODY AND LINEAR COMPRESSOR INCLUDING THE SAME

CROSS-REFERENCE TO RELATED APPLICATIONS

This application claims the benefit of Korea Patent Application No. 10-2020-0178607, filed on Dec. 18, 2020, which is incorporated herein by reference for all purposes as if fully set forth herein.

BACKGROUND OF THE INVENTION

Field of the Invention

The present disclosure relates to an elastic body and a linear compressor including the elastic body. More particularly, the present disclosure relates to an elastic body for a linear compressor configured to compress a refrigerant by the linear reciprocating motion of a piston and a linear compressor including the elastic body.

Discussion of the Related Art

In general, a compressor refers to a device that is configured to receive power from a power generator such as a motor or a turbine and compress a working fluid such as air or a refrigerant. More specifically, the compressors are widely used in the whole industry or home appliances, especially a steam compression refrigeration cycle (hereinafter, referred to as "refrigeration cycle").

The compressors may be classified into a reciprocating compressor, a rotary compressor, and a scroll compressor according to a method of compressing the refrigerant.

The reciprocating compressor uses a method in which a compression space is formed between a piston and a cylinder, and the piston linearly reciprocates to compress a fluid. The rotary compressor uses a method of compressing a fluid by a roller that eccentrically rotates inside a cylinder. The scroll compressor uses a method of compressing a fluid by engaging and rotating a pair of spiral scrolls.

Recently, among the reciprocating compressors, the use of linear compressors that use a linear reciprocating motion without using a crank shaft is gradually increasing. The linear compressor has advantages in that it has less mechanical loss resulting from switching a rotary motion to the linear reciprocating motion and thus can improve the efficiency, and has a relatively simple structure.

The linear compressor is configured such that a cylinder is positioned in a casing forming a sealed space to form a compression chamber, and a piston covering the compression chamber reciprocates inside the cylinder. The linear compressor repeats a process in which a fluid in the sealed space is sucked into the compression chamber while the piston is positioned at a bottom dead center (BDC), and the fluid of the compression chamber is compressed and discharged while the piston is positioned at a top dead center (TDC).

A compression unit and a drive unit (motor or driver) are installed, respectively, in the linear compressor. The compression unit performs the process of compressing and discharging the refrigerant while being axially reciprocated through the movement of the drive unit.

The piston of the linear compressor repeatedly performs a series of processes of sucking the refrigerant through an intake pipe into a casing while being reciprocated at high speed in the cylinder by a resonant spring, discharging the refrigerant out from a compression space by the forward movement of the piston, and moving the discharged refrigerant through a discharge pipe to a condenser.

Generally, a coil spring has been widely used for the resonant spring. However, in the case of using the coil spring, multiple coil springs are used to reduce the eccentricity and/or tilting of a mover. Thus, there is a limit to miniaturize the linear compressor. Furthermore, in order to offset the lateral force of each coil spring, it is complicated to uniformly arrange the multiple coil springs and to align the direction of each coil spring, when the multiple coil springs are coupled.

Recently, in order to solve the above-described problems of the coil spring, technologies where a plate spring may be used for the resonant spring have been developed. Such a plate spring is usually formed of one metal plate, and is composed of a plurality of bent spring elements.

Such a linear compressor is disclosed in Korean Patent Laid-Open Publication No. 10-2005-0031777 (hereinafter referred to as Prior Art 1) and Japanese Patent Laid-Open Publication Heisei. 11-324914 (hereinafter referred to as Prior Art 2).

Meanwhile, a conventional plate spring is manufactured by punching space between a plurality of elastic portions which are spirally formed from one metal plate. In this case, if the width of a portion which is to be punched is small, an area of the portion which is in contact with the metal plate to be punched in a punching machine should be small. Thus, high pressure is applied to the portion which is to be punched, so that there is a risk of damage to the punching machine. Therefore, the conventional plate spring is usually configured such that a width of space between a plurality of spiral elastic portions is 1.5 times or more as large as the thickness of the plate spring.

However, if the thickness of the elastic portion of the plate spring increases, rigidity (N/m) increases, and consequently, the efficiency of the compressor may increase. However, since the conventional plate spring is manufactured through a punching process, the thicker the plate spring is, the more the portion to be punched is. Thus, referring to FIG. 14, there is a problem that a portion of the metal plate which is lost increases, so that the increase rate of the rigidity (N/m) is significantly reduced as the thickness of the plate spring increases.

Furthermore, there is a problem that a process yield is lowered due to the loss of the metal plate when an elastic body is manufactured.

Furthermore, since there is a limit to increase the thickness of the plate spring, the conventional linear compressor is configured such that a plurality of thin plate springs is axially arranged. In this case, due to the plurality of plate springs and a spacer disposed between the plate springs, the space efficiency of the internal space of the linear compressor is deteriorated.

Furthermore, referring to FIG. 18, in the case of an integral plate spring, stress (MPa) concentrates on an outer portion A and an inner portion B of each of the multiple elastic portions, so that the reliability and durability of the plate spring are reduced.

PRIOR ART DOCUMENT (Patent Document 1) Korean Patent Laid-Open Publication No. 10-2005-0031777 A (Mar. 6, 2005)

(Patent Document 2) Japanese Patent Laid-Open Publication Heisei. 11-324914 A (Nov. 26, 1999)

SUMMARY OF THE INVENTION

An object of the present disclosure is to improve the increase rate of rigidity (N/m) due to an increase in thickness of an elastic body, and to improve the performance of the elastic body.

Furthermore, concentration of stress (MPa) on a specific portion of an elastic body is prevented, thus improving the durability and reliability of the elastic body.

Furthermore, a loss of a metal plate is reduced when an elastic body is manufactured, and a process yield is improved.

Furthermore, the alignment and/or arrangement of a plurality of elastic units are facilitated, thus simplifying a manufacturing process.

Furthermore, the number of elastic bodies is reduced, thus improving the space efficiency of an internal space of a linear compressor.

Furthermore, an arrangement distance between a plurality of elastic units and the radial and/or circumferential arrangement of an outer portion and/or inner portion are easily identified, thus allowing the plurality of elastic units to be easily aligned.

Furthermore, a manufacturing process is simplified during a laser cutting process, and a manufacturing time is reduced.

Furthermore, when a linear compressor is operated, interference between an outer portion and/or an inner portion of each of a plurality of elastic units is minimized, thus minimizing abrasion and noise due to the interference.

Furthermore, a rotational moment which may occur in each of a plurality of elastic units is effectively prevented.

Furthermore, an outer portion and/or an inner portion of each of a plurality of elastic units are firmly fixed, and an elastic force generated from each of the plurality of elastic units is effectively transmitted to a piston.

Furthermore, damage due to distortion caused by a slight difference in moving direction of a plurality of elastic units is prevented.

In order to accomplish the objects, an elastic body according to an aspect of the present disclosure may include a plurality of elastic units disposed circumferentially around an axis, each of the plurality of elastic units may have a corresponding shape, each of the plurality of elastic units may include an elastic portion that is spirally formed while moving away from the axis, an outer portion disposed on an outside of the elastic portion in a radial direction thereof, and an inner portion disposed on an inside of the elastic portion in the radial direction thereof, the outer portion may be adjacent to the outer portion of an adjacent elastic unit, the inner portion may be adjacent to the inner portion of the adjacent elastic unit, and a slit may be formed between each of the elastic portions.

Thereby, since the width of the slit is not affected by the thickness of the elastic body, the width of the slit can be reduced, and the performance of the elastic body can be improved.

Furthermore, since multiple elastic units are independent from each other, concentration of stress (MPa) on a specific portion of an elastic body can be prevented, and thereby the durability and reliability of the elastic body can be improved.

Furthermore, space between multiple elastic units is minimized, so that a loss of a metal plate can be minimized when an elastic body is manufactured, and a process yield can be improved.

Furthermore, since outer portions are adjacent to each other and inner portions are adjacent to each other, the alignment and/or arrangement of a plurality of elastic units can be facilitated.

Furthermore, since the number of elastic bodies may be reduced due to improvement on the performance of the elastic body, the space efficiency of internal space of a linear compressor can be improved.

Furthermore, when the thickness of the elastic body increases, the width of the slit is constant, and the increase rate of rigidity (N/m) of the elastic body due to an increase in thickness of the elastic body can have a positive value.

Furthermore, when the thickness of the elastic body increases, the width of the slit is constant, and the rigidity (N/m) of the elastic body can be proportional to the square of the thickness of the elastic body.

Thereby, since the increase rate of the rigidity (N/m) due to an increase in thickness of the elastic body is not reduced, the performance of the elastic body can be improved.

Furthermore, a clockwise end of the outer portion of each of the plurality of elastic units may be formed in a shape that is the same as that of a counterclockwise end of the outer portion of an adjacent elastic unit in a clockwise direction.

Thereby, when multiple elastic units are arranged, a distance between the elastic units can be easily identified.

Furthermore, an outer boundary portion may be formed between the outer portions of the plurality of elastic units, and the outer boundary portion may extend from an outer end of the slit outwards in a radial direction thereof.

Thereby, since it is easy to identify the radial arrangement of adjacent outer portions, a plurality of elastic units can be easily aligned.

Furthermore, an outer boundary portion may be formed between outer portions of the plurality of elastic units, and a width of the outer boundary portion may be the same as a width of the slit.

Thereby, a manufacturing process can be simplified during a laser cutting process, and a manufacturing time can be shortened.

Furthermore, a clockwise end of the inner portion of each of the plurality of elastic units may be formed in a shape that is the same as that of a counterclockwise end of the inner portion of an adjacent elastic unit in the clockwise direction.

Thereby, when multiple elastic units are arranged, a distance between the elastic units can be easily identified.

Furthermore, an inner boundary portion may be formed between inner portions of the plurality of elastic units, and the inner boundary portion may extend from an inner end of the slit inwards in a radial direction of a spiral travel direction of a spiral formed by the slit.

Thereby, since it is easy to identify the radial arrangement of adjacent outer portions, a plurality of elastic units can be easily aligned.

Furthermore, an inner boundary portion may be formed between inner portions of the plurality of elastic units, and a width of the inner boundary portion may be the same as a width of the slit.

Thereby, a manufacturing process can be simplified during a laser cutting process, and a manufacturing time can be shortened.

Furthermore, the outer portions of the plurality of elastic units may come into contact with each other.

Thereby, a plurality of elastic units can be easily aligned, and the manufacturing time of an elastic body can be shortened.

Furthermore, the outer end of the slit may be bent outwards in the radial direction.

Thereby, when a linear compressor is operated, interference between outer portions of a plurality of elastic units can be minimized.

Furthermore, the inner portions of the plurality of elastic units may come into contact with each other.

Thereby, a plurality of elastic units can be easily aligned, and the manufacturing time of an elastic body can be shortened.

Furthermore, the inner end of the slit may be bent inwards in the radial direction of the spiral travel direction of the spiral formed by the slit.

Thereby, when a linear compressor is operated, interference between inner portions of a plurality of elastic units can be minimized.

Furthermore, the plurality of elastic units may be formed of three elastic units, all of outer edges of the outer portions in a radial direction thereof may be disposed on one outer circumference, all of inner edges of the inner portions in a radial direction thereof may be disposed on one inner circumference, and a shape of each of the plurality of elastic units may correspond to a shape of a space between the elastic units disposed on both sides, the outer circumference, and the inner circumference.

Thereby, since the space between the plurality of elastic units may be minimized, the width of a slit can be reduced, thus improving the performance of the elastic body and reducing a material loss, and thereby increasing a process yield.

Furthermore, since the multiple elastic units are separated from each, a stress concentration phenomenon can be alleviated.

Furthermore, each of the plurality of elastic units may include a plurality of outer coupling holes arranged circumferentially on the outer portion, and any one of the plurality of outer coupling holes may be disposed to be biased toward the clockwise end of the outer portion, and any other outer coupling hole may be disposed to be biased toward the counterclockwise end of the outer portion.

Furthermore, each of the plurality of elastic units may include a plurality of inner coupling holes arranged circumferentially on the inner portion, and any one of the plurality of inner coupling holes may be disposed to be biased toward the clockwise end of the inner portion, and any other inner coupling hole may be disposed to be biased toward the counterclockwise end of the outer portion.

Thereby, it is possible to effectively prevent rotational moment which may occur around the outer coupling hole and/or inner coupling hole in each of the plurality of elastic units.

In order to accomplish the objects, a linear compressor according to an aspect of the present disclosure may include a cylinder; a piston reciprocating along an axis inside the cylinder to axially reciprocate; a drive unit disposed on an outside of the cylinder in a radial direction thereof; an elastic body disposed on a rear of the cylinder and the drive unit in an axial direction; and a connecting member configured to connect the piston and the elastic body.

Here, the elastic body may include a plurality of elastic units disposed circumferentially around an axis, each of the plurality of elastic units may have a corresponding shape, each of the plurality of elastic units may include an elastic portion that is spirally formed while moving away from the axis, an outer portion disposed on an outside of the elastic portion in a radial direction thereof, and an inner portion disposed on an inside of the elastic portion in the radial direction thereof, the outer portion may be adjacent to the outer portion of an adjacent elastic unit, the inner portion may be adjacent to the inner portion of the adjacent elastic unit, and a slit may be formed between each of the elastic portions.

Thereby, since the width of the slit is not affected by the thickness of the elastic body, the width of the slit can be reduced and the performance of the elastic body can be improved.

Furthermore, since the multiple elastic units are independent from each other, concentration of stress (MPa) on a specific portion of the elastic body can be prevented, and thereby the durability and reliability of the elastic body can be improved.

Furthermore, since the space between the plurality of elastic units is minimized, the loss of a metal plate can be minimized when the elastic body is manufactured, and a process yield can be improved.

Furthermore, since the outer portions are adjacent to each other and the inner portions are adjacent to each other, the alignment and/or arrangement of the plurality of elastic units can be facilitated.

Furthermore, since the number of elastic bodies may be reduced due to improvement on the performance of the elastic body, the space efficiency of internal space of the linear compressor can be improved.

Furthermore, the connecting member may include a plate disposed on a front of the inner portion in an axial direction thereof, and a rod coupled at a first end thereof to the piston and coupled at a second end thereof to a central area of the plate in a radial direction thereof, and the inner portion may be fixed to the plate.

Thus, a plurality of elastic units can be fixed through the plate of the connecting member, and elastic forces formed in each of the plurality of elastic units can be integrated into one to be effectively transmitted to the piston.

Furthermore, the plate may include a ring portion that overlaps the front of the inner portion in the axial direction thereof and is circumferentially formed, and a plurality of ribs that connect the second end of the rod and the ring portion, the plurality of ribs may be formed in a same number as that of the plurality of elastic units, and an outer end of each of the plurality of ribs may be connected to the ring portion in a central area in a circumferential direction of the inner portion.

Thus, the inner portions of the plurality of elastic units in the radial direction may be firmly fixed through the ring portion of the integrally formed plate.

Furthermore, the elastic force generated from each of the plurality of elastic units can be effectively transmitted to each rib.

Furthermore, damage to the plate due to distortion caused by a slight difference in moving direction of the plurality of elastic units can be prevented.

Furthermore, a fixing member disposed between the drive unit and the outer portion may be included, the fixing member may be integrally formed in a circumferential direction, and the outer portion may be fixed to the fixing member.

Thus, the outer portions of the plurality of elastic units can be firmly fixed through the integrally formed fixing member.

According to one aspect of the subject matter described in this application, an elastic body includes a plurality of elastic plates that are disposed about an axis and surround the axis in a circumferential direction, where the plurality of elastic plates face one another in a radial direction and define a slit radially between adjacent elastic plates among the plurality of elastic plates. Each of the plurality of elastic plates includes an elastic portion that spirally extends about the axis and away from the axis in the radial direction, an outer portion disposed at an outside of the elastic portion in the radial direction, and an inner portion disposed at an inside of the elastic portion in the radial direction. The outer portion of a first elastic plate among the plurality of elastic plates is disposed adjacent to the outer portion of a second elastic plate among the plurality of elastic plates, and the inner portion of the first elastic plate is disposed adjacent to the inner portion of the second elastic plate.

Implementations according to this aspect can include one or more of the following features. For instance, a width of the slit can be constant along the plurality of elastic plates, where a rigidity (N/m) of the elastic body is defined by a ratio of a force applied to the elastic body with respect to a displacement of the elastic body by the force. In some examples, the rigidity of the elastic body can increase based on an increase of a thickness of the elastic body in an axial direction, where an increase rate of the rigidity of the elastic body has a positive value such that the increase rate of the rigidity of the elastic body increases based on the increase of the thickness of the elastic body. In some implementations, the rigidity of the elastic body can increase based on an increase of a thickness of the elastic body and is proportional to a square of the thickness of the elastic body.

In some implementations, the outer portion of each of the plurality of elastic plates can have a clockwise end and a counterclockwise end, where the first elastic plate and the second elastic plate are arranged adjacent to each other along a clockwise direction about the axis, the clockwise end of the first elastic plate facing the counterclockwise end of the second elastic plate. A shape of the clockwise end of the first elastic plate can correspond to a shape of the counterclockwise end of the second elastic plate. For instance, the shapes can be identical to each other.

In some examples, the plurality of elastic plates can define an outer boundary portion between the outer portion of the first elastic plate and the outer portion of the second elastic plate, where the outer boundary portion extends outward from an outer end of the slit in the radial direction. In some examples, the plurality of elastic plates can define an outer boundary portion between the outer portion of the first elastic plate and the outer portion of the second elastic plate, where a width of the outer boundary portion is equal to a width of the slit.

In some implementations, the inner portion of each of the plurality of elastic plates can have a clockwise end and a counterclockwise end, where the first elastic plate and the second elastic plate are arranged adjacent to each other along a clockwise direction about the axis, the clockwise end of the first elastic plate facing the counterclockwise end of the second elastic plate. A shape of the clockwise end of the first elastic plate can correspond to a shape of the counterclockwise end of the second elastic plate. For instance, the shapes can be identical to each other.

In some examples, the slit can extend along a spiral travel direction and have an inner end that faces the axis and an outer end disposed outward relative to the inner end in the radial direction, where the plurality of elastic plates define an inner boundary portion between the inner portion of the first elastic plate and the inner portion of the second elastic plate. The inner boundary portion can extend from the inner end of the slit toward the axis in the radial direction. In some examples, the plurality of elastic plates can define an inner boundary portion between the inner portion of the first elastic plate and the inner portion of the second elastic plate, and where a width of the inner boundary portion is equal to a width of the slit.

In some implementations, the outer portions of the plurality of elastic plates can be configured to contact one another. In some examples, an outer end of the slit is bent outwards in the radial direction. In some implementations, the inner portions of the plurality of elastic plates can be configured to contact one another. In some examples, the slit can extend along a spiral travel direction and have an inner end that faces the axis and an outer end that is disposed outward relative to the inner end in the radial direction, where the inner end of the slit is bent toward the axis in the radial direction.

In some implementations, the plurality of elastic plates can have three elastic plates, where outer edges of the outer portions of the three elastic plates define an outer circumference of the elastic body, and inner edges of the inner portions of the three elastic plates define an inner circumference of the elastic body. A shape of each of the three elastic plates can correspond to a shape of a space defined between two of the three elastic plates, the outer circumference, and the inner circumference.

In some implementations, the outer portion of each of the plurality of elastic plates can have a clockwise end and a counterclockwise end, where each of the plurality of elastic plates defines a plurality of outer coupling holes that are arranged circumferentially in the outer portion. The plurality of outer coupling holes can include a first outer coupling hole defined at a position closer to the clockwise end of the outer portion than to the counterclockwise end of the outer portion, and a second outer coupling hole defined at a position closer to the counterclockwise end of the outer portion than to the clockwise end of the outer portion.

In some implementations, the inner portion of each of the plurality of elastic plates can have a clockwise end and a counterclockwise end, where each of the plurality of elastic plates defines a plurality of inner coupling holes that are arranged circumferentially on the inner portion. The plurality of inner coupling holes can include a first inner coupling hole defined at a position closer to the clockwise end of the inner portion and to the counterclockwise end of the outer portion, and a second inner coupling hole defined at a position closer to the counterclockwise end of the outer portion than to the clockwise end of the inner portion.

According to another aspect, a linear compressor includes a cylinder, a piston disposed in the cylinder and configured to reciprocate along an axis of the cylinder, a driver disposed at an outside of the cylinder in a radial direction, an elastic body disposed rearward relative to the cylinder and the driver in an axial direction, and a connector that connects the piston to the elastic body. The elastic body can include a plurality of elastic plates that are disposed about an axis and surround the axis in a circumferential direction, where the plurality of elastic plates face one another in the radial direction and define a slit between adjacent elastic plates among the plurality of elastic plates. Each of the plurality of elastic plates includes an elastic portion that spirally extends about the axis and away from the axis in the radial direction, an outer portion disposed at an outside of the elastic portion in the radial direction, and an inner portion disposed at an inside of the elastic portion in the radial direction. The outer portion of a first elastic plate among the plurality of elastic plates is disposed adjacent to the outer portion of a second elastic plate among the plurality of elastic plates, and the inner portion of the first elastic plate is disposed adjacent to the inner portion of the second elastic plate.

Implementations according to this aspect can include one or more of the following features or the features described above. For example, the connector can include a connecting plate disposed forward relative to the inner portion of each of the plurality of elastic plates in the axial direction and fixed to the inner portion of each of the plurality of elastic plates, and a rod that couples the piston to the connecting plate, where the rod has a first end connected to the piston and a second end connected to a central area of the connecting plate adjacent to the axis.

In some implementations, the connecting plate can include a ring portion that overlaps with a front side of the inner portion in the axial direction and extends in the circumferential direction, and a plurality of ribs that connect the second end of the rod to the ring portion, where a number of the plurality of ribs is equal to a number of the plurality of elastic plates. An outer end of each of the plurality of ribs can be connected to the ring portion and disposed in a central region defined by the inner portions of the plurality of elastic plates.

In some implementations, the linear compressor can include a fixing member disposed between the driver and the outer portions and fixed to the outer portions, where the fixing member extends in the circumferential direction.

According to the present disclosure, the increase rate of rigidity (N/m) can be improved due to an increase in thickness of an elastic body, and thereby the performance of the elastic body can be improved.

Furthermore, since the width of a slit may be made small, a loss of a metal plate can be reduced when an elastic body is manufactured, and thereby a process yield can be improved.

Furthermore, since the number of elastic bodies may be reduced due to improvement on performance of the elastic body, the space efficiency of an internal space of a linear compressor can be improved.

Furthermore, concentration of stress (MPa) on a specific portion of an elastic body can be prevented, thus improving the durability and reliability of the elastic body.

Furthermore, when multiple elastic units are arranged, a distance between the elastic units is easily identified and the radial and/or circumferential arrangement of an outer portion and/or inner portion is easily identified, thus allowing the multiple elastic units to be easily aligned.

Furthermore, a manufacturing process can be simplified during a laser cutting process, and a manufacturing time can be shortened.

Furthermore, when a linear compressor is operated, interference between an outer portion and/or an inner portion of each of a plurality of elastic units is minimized, thus minimizing abrasion and noise due to the interference.

Furthermore, a rotational moment which may occur in each of a plurality of elastic units can be effectively prevented.

Furthermore, a plurality of elastic units can be fixed through the plate of the connecting member, and elastic forces formed in each of the plurality of elastic units can be integrated into one to be effectively transmitted to the piston.

Furthermore, the inner portions of the plurality of elastic units in the radial direction may be firmly fixed through the ring portion of the integrally formed plate.

Furthermore, through the connecting location of the outer end of the rib in the radial direction, the elastic force generated from each of the plurality of elastic units can be effectively transmitted to each rib.

Furthermore, damage to the plate due to distortion caused by a slight difference in moving direction of the plurality of elastic units can be prevented.

Furthermore, the outer portions of the plurality of elastic units in the radial direction can be firmly fixed through the integrally formed fixing member.

BRIEF DESCRIPTION OF THE DRAWINGS

The accompanying drawings, that may be included to provide a further understanding of the disclosure and are incorporated in and constitute a part of this specification, illustrate embodiments of the disclosure and together with the description serve to explain various principles of the disclosure.

DETAILED DESCRIPTION OF THE EMBODIMENTS

Reference will now be made in detail to embodiments of the disclosure, examples of which are illustrated in the accompanying drawings. Wherever possible, the same reference numbers will be used throughout the drawings to refer to the same or like parts.

In embodiments of the disclosure, when an arbitrary component is described as "being connected to" or "being coupled to" other component, it should be understood that another component(s) may exist between them, although the arbitrary component may be directly connected or coupled to the other component.

It will be noted that a detailed description of known arts will be omitted if it is determined that the detailed description of the known arts can obscure embodiments of the disclosure. The accompanying drawings are used to help easily understand various technical features and it should be understood that embodiments presented herein are not limited by the accompanying drawings. As such, the present disclosure should be understood to extend to any alterations, equivalents and substitutes in addition to those which are particularly set out in the accompanying drawings.

In addition, a term of "disclosure" may be replaced by document, specification, description, etc.

Figure 1:
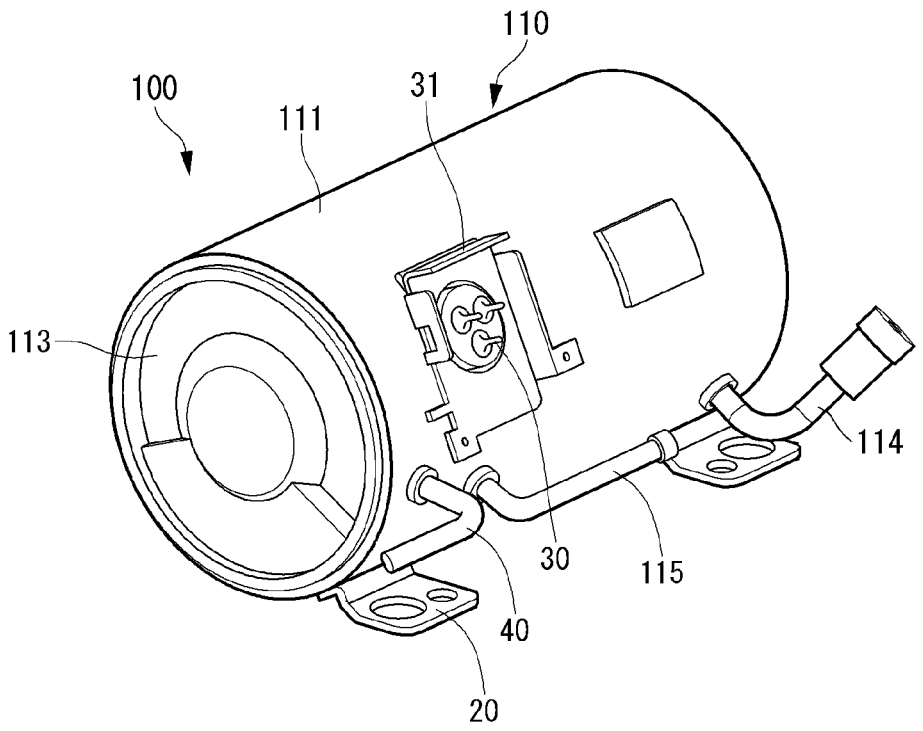
FIG. 1 is a perspective view of a linear compressor in accordance with an embodiment of the present disclosure.

FIG. 1 is a perspective view of a linear compressor 100 in accordance with a first embodiment of the present disclosure.

Referring to FIG. 1, the linear compressor 100 in accordance with the first embodiment of the present disclosure may include a casing 110. The casing 110 may include a shell 111 and shell covers 112 and 113 coupled to the shell 111. In a broad sense, the shell covers 112 and 113 may be understood as a component of the shell 111.

Legs 20 may be coupled to a lower side of the shell 111. The legs 20 may be coupled to a base of a product on which the linear compressor 100 is mounted. For example, the product may include a refrigerator, and the base may include a machine room base of the refrigerator. As another example, the product may include an outdoor unit of an air conditioner, and the base may include a base of the outdoor unit.

The shell 111 may have a substantially cylindrical shape and may be disposed to lie in a horizontal direction or an axial direction. FIG. 1 illustrates that the shell 111 is extended in the horizontal direction and has a slightly low height in a radial direction, by way of example. That is, since the linear compressor 100 can have a low height, there is an advantage in that a height of the machine room can decrease when the linear compressor 100 is installed in, for example, the machine room base of the refrigerator.

A longitudinal central axis of the shell 111 coincides with a central axis of a main body of the linear compressor 100 to be described later, and the central axis of the main body of the linear compressor 100 coincides with a central axis of a cylinder 140 and a piston 150 constituting the main body of the linear compressor 100.

A terminal 30 may be installed on an external surface of the shell 111. The terminal 30 may transmit external electric power to a drive unit 130 (or driver 130) of the linear compressor 100. More specifically, the terminal 30 may be connected to a lead line of a coil 132*b*. In some examples, the driver 130 can include a motor including a stator and a rotor.

A bracket 31 may be installed on the outside of the terminal 30. The bracket 31 may include a plurality of brackets surrounding the terminal 30. The bracket 31 may perform a function of protecting the terminal 30 from an external impact, etc.

Both sides of the shell 111 may be opened. The shell covers 112 and 113 may be coupled to both sides of the opened shell 111. More specifically, the shell covers 112 and 113 may include a first shell cover 112 coupled to one opened side of the shell 111 and a second shell cover 113 coupled to the other opened side of the shell 111. An inner space of the shell 111 may be sealed by the shell covers 112 and 113.

FIG. 1 illustrates that the first shell cover 112 is positioned on the right side of the linear compressor 100, and the second shell cover 113 is positioned on the left side of the linear compressor 100, by way of example. In other words, the first and second shell covers 112 and 113 may be disposed to face each other. It can be understood that the first shell cover 112 is positioned on a suction side of a refrigerant, and the second shell cover 113 is positioned on a discharge side of the refrigerant.

The linear compressor 100 may include a plurality of pipes 114, 115, and 40 that are included in the shell 111 or the shell covers 112 and 113 and can suck, discharge, or inject the refrigerant.

The plurality of pipes 114, 115, and 40 may include a suction pipe 114 that allows the refrigerant to be sucked into the linear compressor 100, a discharge pipe 115 that allows the compressed refrigerant to be discharged from the linear compressor 100, and a supplementary pipe 40 for supplementing the refrigerant in the linear compressor 100.

For example, the suction pipe 114 may be coupled to the first shell cover 112. The refrigerant may be sucked into the linear compressor 100 along the axial direction through the suction pipe 114.

The discharge pipe 115 may be coupled to an outer circumferential surface of the shell 111. The refrigerant sucked through the suction pipe 114 may be compressed while flowing in the axial direction. The compressed refrigerant may be discharged through the discharge pipe 115. The discharge pipe 115 may be disposed closer to the second shell cover 113 than to the first shell cover 112.

The supplementary pipe 40 may be coupled to the outer circumferential surface of the shell 111. A worker may inject the refrigerant into the linear compressor 100 through the supplementary pipe 40.

The supplementary pipe 40 may be coupled to the shell 111 at a different height from the discharge pipe 115 in order to prevent interference with the discharge pipe 115. Here, the height may be understood as a distance measured from the leg 20 in a vertical direction. Because the discharge pipe 115 and the supplementary pipe 40 are coupled to the outer circumferential surface of the shell 111 at different heights, the work convenience can be attained.

On an inner circumferential surface of the shell 111 corresponding to a location at which the supplementary pipe 40 is coupled, at least a portion of the second shell cover 113 may be positioned adjacently. In other words, at least a portion of the second shell cover 113 may act as a resistance of the refrigerant injected through the supplementary pipe 40.

Thus, a size of the flow path of the refrigerant introduced through the supplementary pipe 40 is configured to decrease by the second shell cover 113 while the refrigerant enters into the inner space of the shell 111, and again increase while the refrigerant passes through the second shell cover 113. In this process, a pressure of the refrigerant may be reduced to vaporize the refrigerant, and an oil contained in the refrigerant may be separated. Thus, while the refrigerant, from which the oil is separated, is introduced into the piston 150, a compression performance of the refrigerant can be improved. The oil may be understood as a working oil present in a cooling system.

Figure 2:
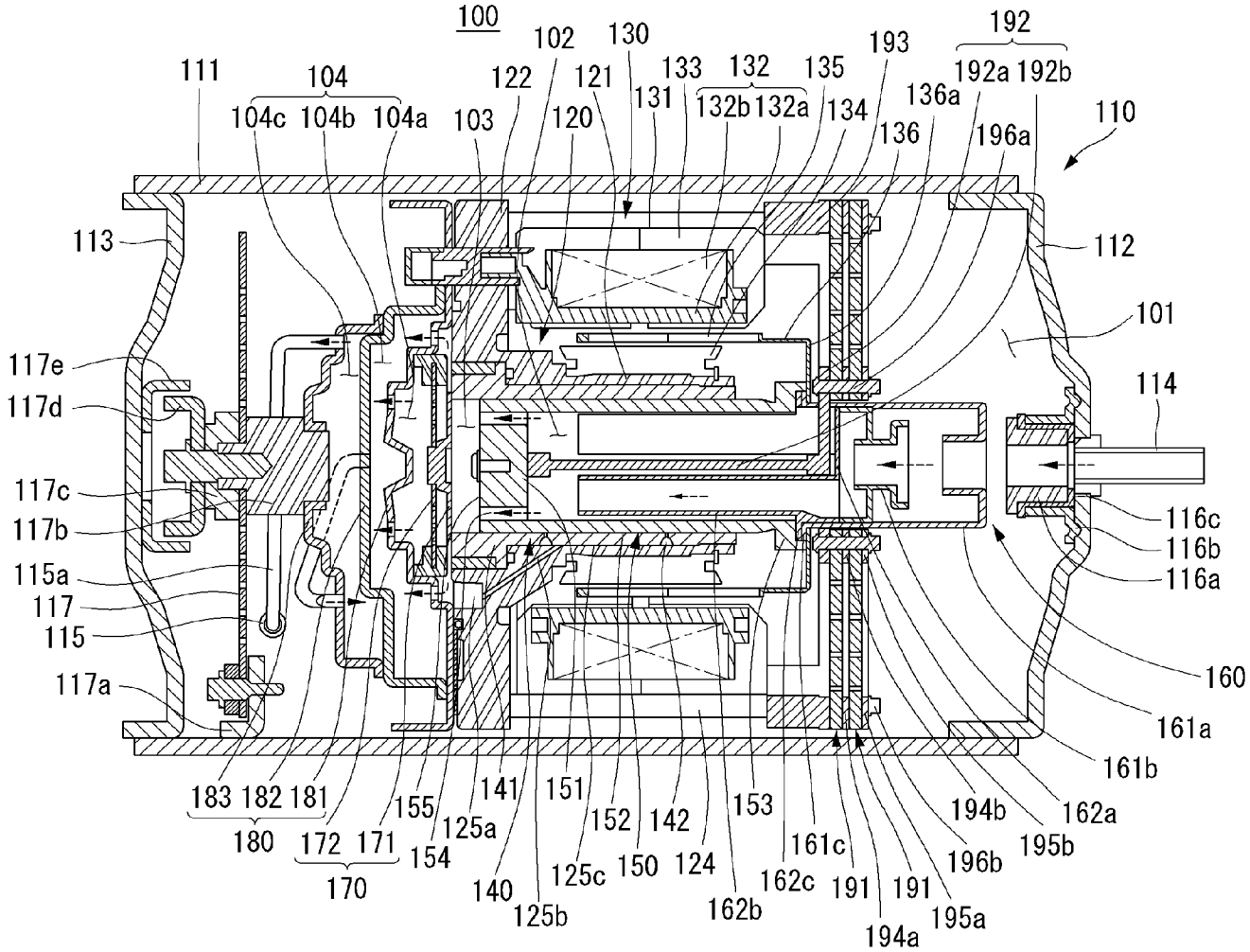
FIG. 2 is a sectional view of the linear compressor in accordance with an embodiment of the present disclosure.
Figure 3:
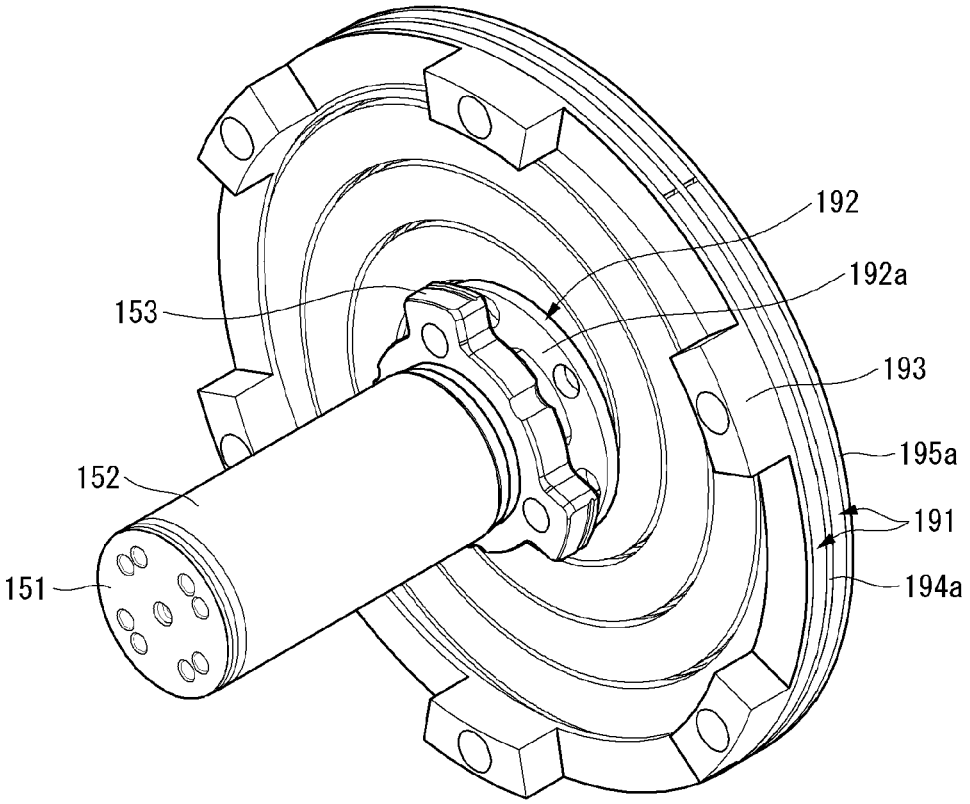
FIG. 3 is a perspective view of some components of a linear compressor in accordance with a first embodiment of the present disclosure.
Figure 4:
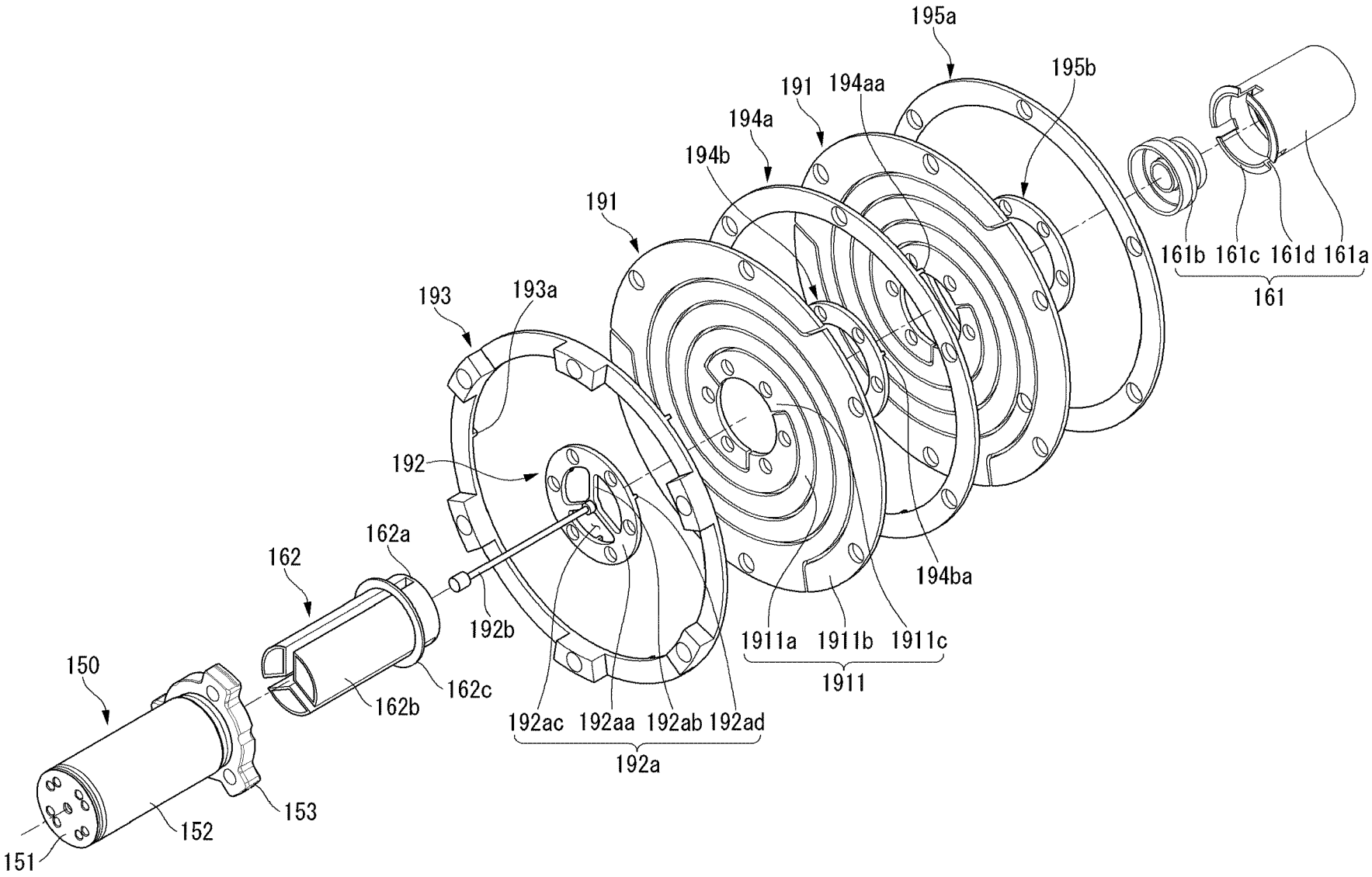
FIG. 4 is an exploded perspective view of some components of the linear compressor in accordance with the first embodiment of the present disclosure.
Figure 5:
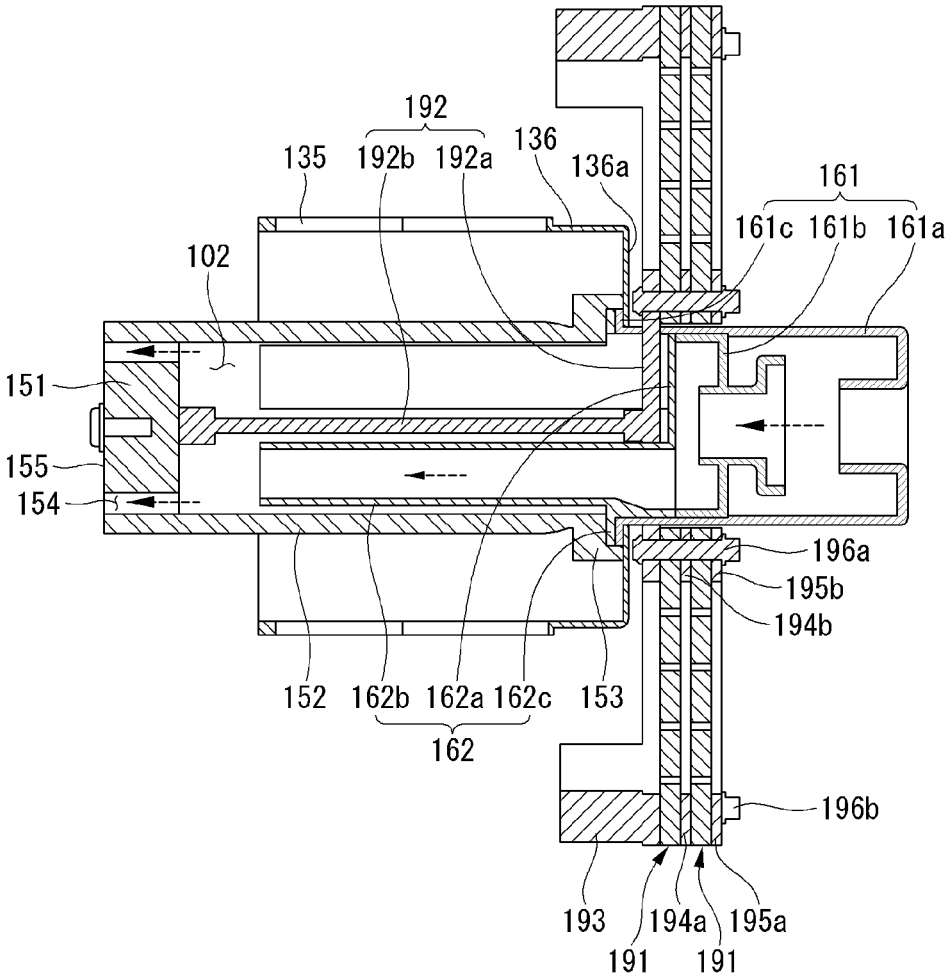
FIG. 5 is a sectional view of some components of the linear compressor in accordance with the first embodiment of the present disclosure.
Figure 6:
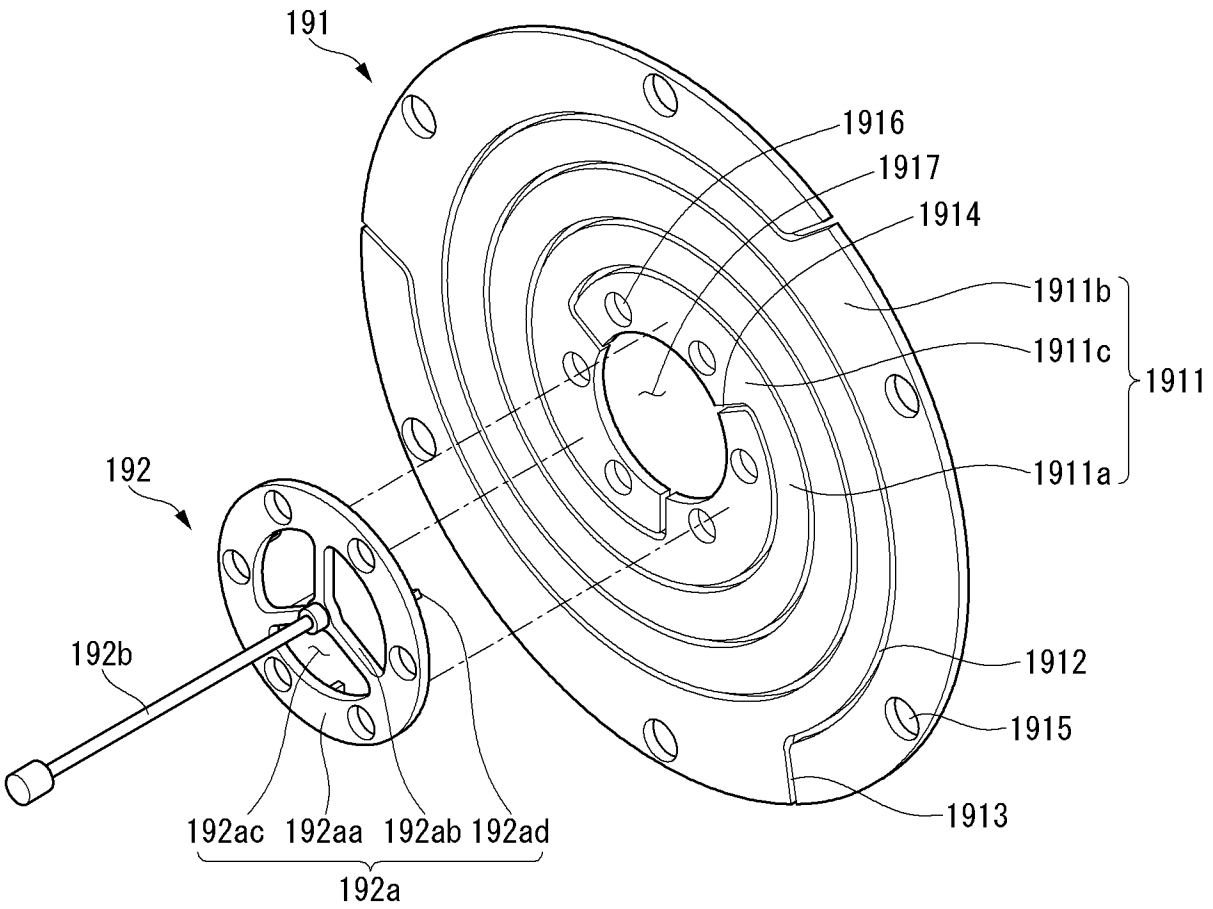
FIG. 6 is an exploded perspective view illustrating an elastic body and a connector in accordance with the first embodiment of the present disclosure.
Figure 7:
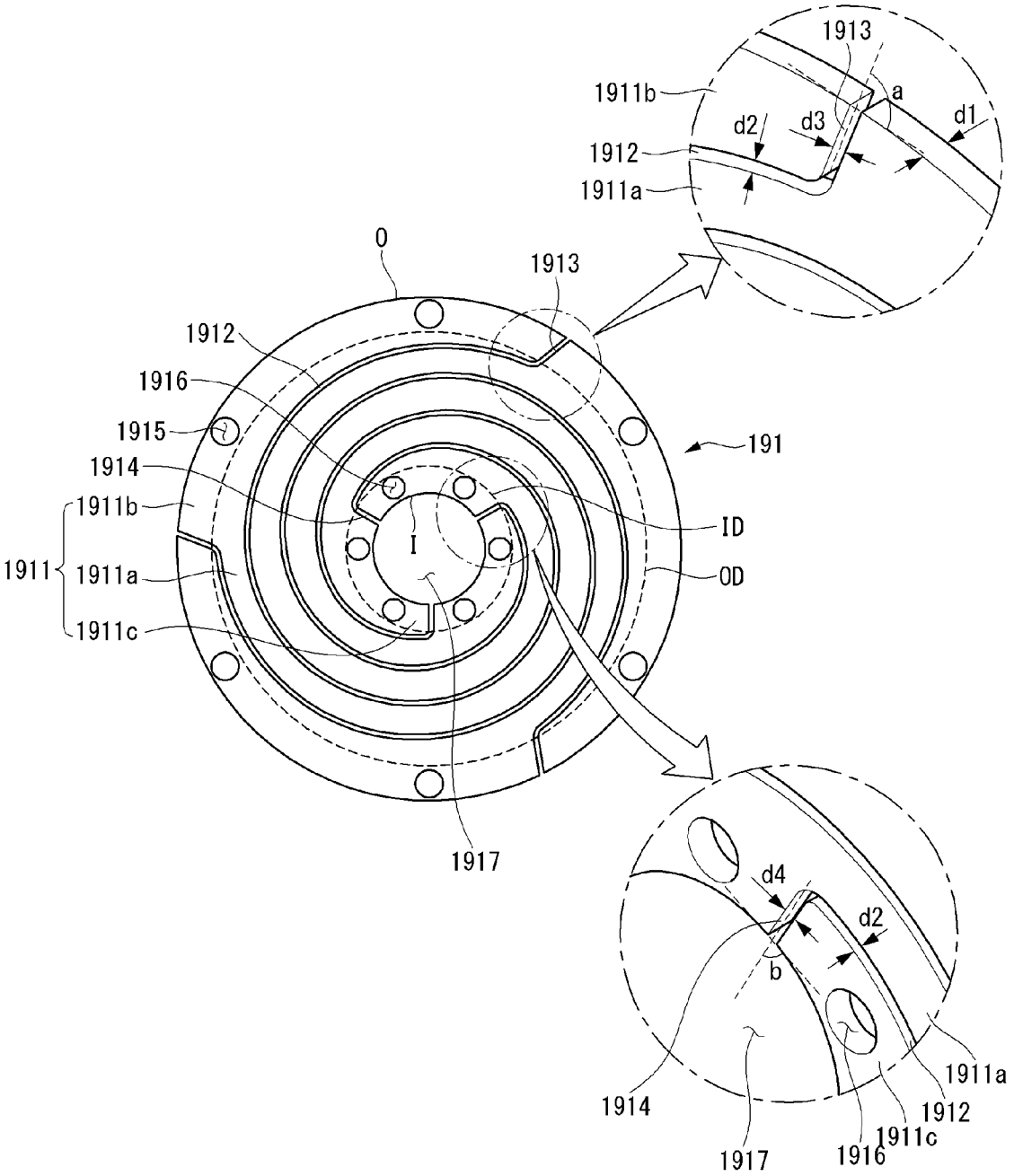
FIG. 7 illustrates the elastic body in accordance with the first embodiment of the present disclosure in a front view and a partial perspective view.
Figure 8:
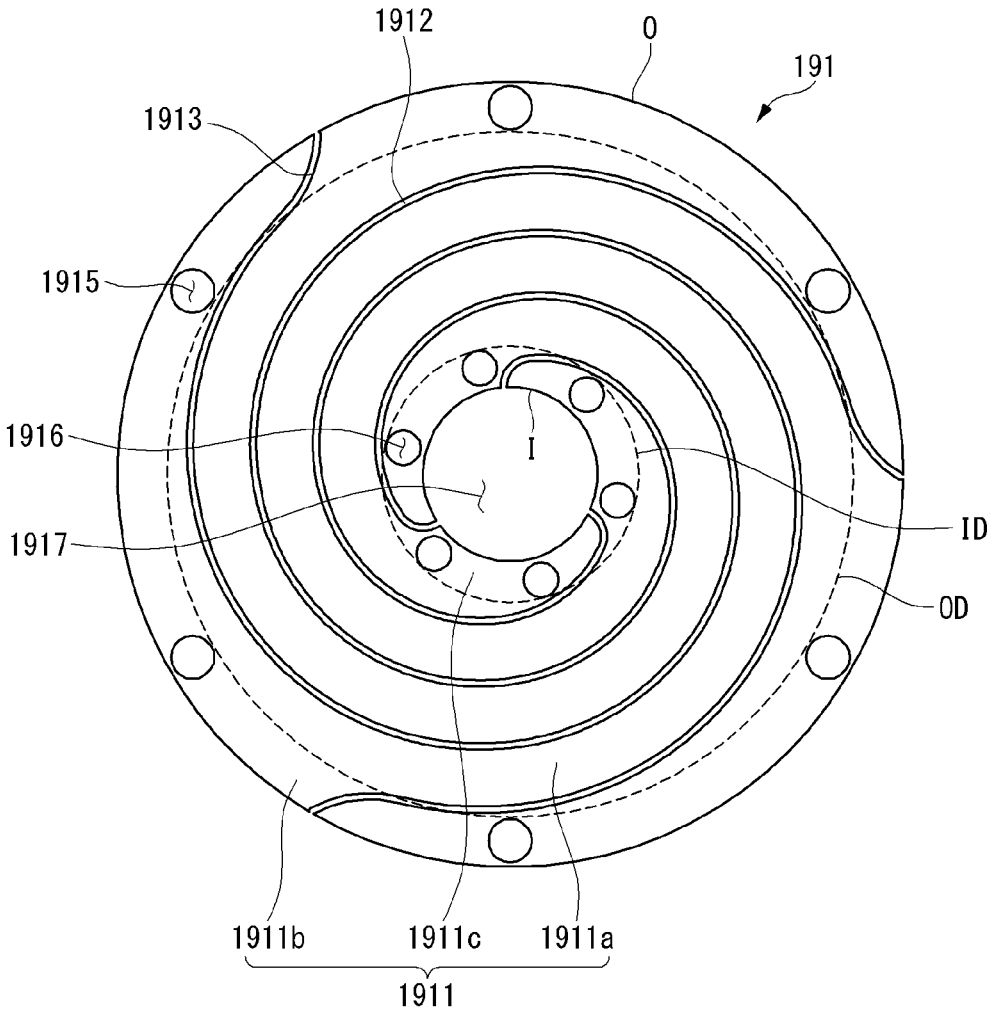
FIG. 8 is a front view of an elastic body in accordance with a second embodiment of the present disclosure.

FIG. 2 is a sectional view of the linear compressor 100 in accordance with the first embodiment of the present disclosure. FIG. 3 is a perspective view of some components of the linear compressor 100 in accordance with the first embodiment of the present disclosure. FIG. 4 is an exploded perspective view of some components of the linear compressor 100 in accordance with the first embodiment of the present disclosure. FIG. 5 is a sectional view of some components of the linear compressor 100 in accordance with the first embodiment of the present disclosure. FIG. 6 is an exploded perspective view illustrating an elastic body 191 and a connecting member (a connector) in accordance with the first embodiment of the present disclosure. FIG. 7 illustrates the elastic body 191 in accordance with the first embodiment of the present disclosure in a front view and a partial perspective view. FIG. 8 is a front view of an elastic body 191 in accordance with a second embodiment of the present disclosure.

Hereinafter, a compressor according to the present disclosure will be described taking, as an example, a linear compressor 100 that sucks and compresses a fluid while a piston 150 linearly reciprocates, and discharges the compressed fluid.

Although the linear compressor 100 in accordance with the first embodiment of the present disclosure may include the cylinder 140, the piston 150, the muffler unit 160, the elastic body 191, the connecting member or connector 192, and the fixing member 193, some of these components may be excluded, and additional components may be included.

The detailed configuration of the linear compressor 100 including the elastic body 191 of the present disclosure according to FIGS. 8 to 13, which will not be described below, may be understood to be the same as the detailed configuration of the linear compressor 100 of the present disclosure according to FIGS. 2 to 7.

The linear compressor 100 may be a component of a refrigeration cycle, and the fluid compressed in the linear compressor may be a refrigerant circulating the refrigeration cycle. The refrigeration cycle may include a condenser, an expander, an evaporator, etc., in addition to the compressor. The linear compressor 100 may be used as a component of the cooling system of the refrigerator, but is not limited thereto. The linear compressor can be widely used in the whole industry.

Referring to FIG. 2, the linear compressor 100 may include a casing 110 and a main body received in the casing 110. The main body of the linear compressor 100 may include a frame 120, the cylinder 140 fixed to the frame 120, the piston 150 that linearly reciprocates inside the cylinder 140, the drive unit 130 that is fixed to the frame 120 and gives a driving force to the piston 150, and the like. Here, the cylinder 140 and the piston 150 may be referred to as compression units 140 and 150.

The linear compressor 100 may include a bearing means for reducing a friction between the cylinder 140 and the piston 150. The bearing means may be an oil bearing or a gas bearing. Alternatively, a mechanical bearing may be used as the bearing means.

The body of the linear compressor 100 may be elastically supported by a forward support spring 117 installed an inner front end of the casing 110. The forward support spring 117 may include a plate spring and a coil spring. The forward support spring 117 may absorb vibration and shock generated by the reciprocating motion of the piston 150 while supporting the internal components of the body of the linear compressor 100.

The body of the linear compressor 100 may be elastically supported by a rearward support spring (not shown). The rearward support spring may include a plate spring and a coil spring. The rearward support spring may absorb vibration and shock generated by the reciprocating motion of the piston 150 while supporting the internal components of the body of the linear compressor 100, in cooperation with the forward support spring 117.

The casing 110 may form a sealed space. The sealed space may include a receiving space 101 in which the sucked refrigerant is received, a suction space 102 which is filled with the refrigerant before the compression, a compression space 103 in which the refrigerant is compressed, and a discharge space 104 which is filled with the compressed refrigerant.

The refrigerant sucked from the suction pipe 114 connected to the rear side of the casing 110 may be filled in the receiving space 101, and the refrigerant in the suction space 102 communicating with the receiving space 101 may be compressed in the compression space 103, discharged into the discharge space 104, and discharged to the outside through the discharge pipe 115 connected to the front side of the casing 110.

The casing 110 may include the shell 111 formed in a substantially cylindrical shape that is open at both ends and is long in a transverse direction, the first shell cover 112 coupled to the rear side of the shell 111, and the second shell cover 113 coupled to the front side of the shell 111. Here, it can be understood that the front side is the left side of the figure and is a direction in which the compressed refrigerant is discharged, and the rear side is the right side of the figure and is a direction in which the refrigerant is introduced. Further, the first shell cover 112 and the second shell cover 113 may be formed as one body with the shell 11.

The casing 110 may be formed of a thermally conductive material. Hence, heat generated in the inner space of the casing 110 can be quickly dissipated to the outside.

The first shell cover 112 may be coupled to the shell 111 in order to seal the rear of the shell 111, and the suction pipe 114 may be inserted and coupled to the center of the first shell cover 112.

The linear compressor 100 may include a suction guide **116*a*. The suction guide 116*a* may have a through passage formed therein. The suction guide 116*a* may be formed in a cylindrical shape. A front outer circumferential surface of the suction guide 116*a* may be coupled to a central opening of the first support spring 116, and a rear end of the suction guide 116*a* may be supported by the first shell cover 112. In this instance, a separate suction side support member 116*b* may be interposed between the suction guide 116*a* and an inner surface of the first shell cover 112**.

A rear side of the suction guide **116*a* may communicate with the suction pipe 114, and the refrigerant sucked through the suction pipe 114 may pass through the suction guide 116*a* and may be smoothly introduced into a muffler unit 160** to be described later.

A damping member 116*c* may be disposed between the suction guide 116*a* and the suction side support member 116*b*. The damping member 116*c* may be formed of a rubber material or the like. Hence, a vibration that may occur in the process of sucking the refrigerant through the suction pipe 114 can be prevented from being transmitted to the first shell cover 112.

The second shell cover 113 may be coupled to the shell 111 to seal the front side of the shell 111, and the discharge pipe 115 may be inserted and coupled through a loop pipe 115*a*. The refrigerant discharged from the compression space 103 may pass through a discharge cover assembly 180 and then may be discharged into the refrigeration cycle through the loop pipe 115*a* and the discharge pipe 115.

A front side of the main body of the linear compressor 100 may be elastically supported by the forward support spring 117 in the radial direction of the shell 111 or the second shell cover 113.

The forward support spring 117 may include a circular leaf spring. An opened center portion of the forward support spring 117 may be supported by a first support guide 117*b* in a rearward direction with respect to the discharge cover assembly 180. An edge of the forward support spring 117 may be supported by a support bracket 117*a* in a forward direction with respect to the inner surface of the shell 111 or the inner circumferential surface of the shell 111 adjacent to the second shell cover 113.

Unlike FIG. 2, the edge of the forward support spring 117 may be supported in the forward direction with respect to the inner surface of the shell 111 or the inner circumferential surface of the shell 111 adjacent to the second shell cover 113 through a separate bracket (not shown) coupled to the second shell cover 113.

The first support guide 117*b* may be formed in a cylindrical shape. A cross section of the first support guide 117*b* may have a plurality of diameters. A front side of the first support guide 117*b* may be inserted into a central opening of the forward support spring 117, and a rear side of the first support guide 117 may be inserted into a central opening of the discharge cover assembly 180. A support cover 117*c* may be coupled to the front side of the first support guide 117*b* with the second support spring 117 interposed therebetween. A cup-shaped second support guide 117*d* that is recessed forward may be coupled to the front side of the support cover 117*c*. A cup-shaped third support guide 117*e* that corresponds to the second support guide 117*d* and is recessed rearward may be coupled to the inside of the second shell cover 113. The second support guide 117*d* may be inserted into the third support guide 117*e* and may be supported in the axial direction and/or the radial direction. In this instance, a gap may be formed between the second support guide 117*d* and the third support guide 117*e*.

The linear compressor 100 may include a frame 120. The frame 120 may include a body portion 121 supporting the outer circumference of the cylinder 140, and a first flange portion 122 connected to one side of the body portion 121 to support the drive unit 130. The first flange portion 122 may extend radially outwards from a front of the body portion 121 in an axial direction thereof. The frame 120 may be elastically supported against the casing 110 by the forward support spring 117, together with the drive unit 130 and the cylinder 140.

The body portion 121 may wrap the outer circumferential surface of the cylinder 140. The body portion 121 may be formed in a cylindrical shape. The first flange portion 122 may extend from a front end of the body portion 121 in the radial direction.

The cylinder 140 may be coupled to an inner circumferential surface of the body portion 121. An inner stator 134 may be coupled to an outer circumferential surface of the body portion 121. For example, the cylinder 140 may be pressed and fitted to the inner circumferential surface of the body portion 121, and the inner stator 134 may be fixed using a separate fixing ring (not shown).

An outer stator 131 may be coupled to a rear surface of the first flange portion 122, and the discharge cover assembly 180 may be coupled to a front surface of the first flange portion 122. For example, the outer stator 131 and the discharge cover assembly 180 may be fixed through a mechanical coupling means.

The linear compressor 100 may include a plurality of bridges 124. The plurality of bridges 124 may be formed in a number corresponding to that of fastening holes formed in the fixing member 193. The plurality of bridges 124 may extend rearwards in an axial direction of the first flange portion 122. The plurality of bridges 124 may extend to the rear end of the outer stator 131. The plurality of bridges 124 may be radially arranged about the axis. Each of the bridges 124 may be disposed in space between core bundles of the outer stator 131. Otherwise, each of the bridges 124 may be disposed on an outside of the outer stator 131 in a radial direction thereof.

The fixing member 193 may be coupled to the rear end of the bridge 124. The fixing member 193 may be coupled to the plurality of bridges 124 by an outer coupling member 196*b*. Here, a fastening groove (not shown) to which the outer coupling member 196*b* may be coupled may be formed in the rear end of each of the bridges 124. In other words, it is to be understood that the first flange portion 122 and the fixing member 193 may be coupled by the plurality of bridges 124, and the outer stator 131 is disposed between the first flange portion 122 and the fixing member 193.

Otherwise, a separate stator cover (not shown) may be disposed between the outer stator 131 and the fixing member 193. Furthermore, the elastic body 191 may be directly fixed to the outer stator 131 without the fixing member 193.

On one side of the front surface of the first flange portion 122, a bearing inlet groove 125*a* forming a part of the gas bearing may be formed, a bearing communication hole 125*b* penetrating from the bearing inlet groove 125*a* to the inner circumferential surface of the body portion 121 may be formed, and a gas groove 125*c* communicating with the bearing communication hole 125*b* may be formed on the inner circumferential surface of the body portion 121.

The bearing inlet groove 125*a* may be recessed to a predetermined depth in the axial direction. The bearing communication hole 125*b* is a hole having a smaller cross-sectional area than the bearing inlet groove 125*a* and may be inclined toward the inner circumferential surface of the body portion 121. The gas groove 125*c* may be formed in an annular shape having a predetermined depth and an axial length on the inner circumferential surface of the body portion 121. Alternatively, the gas groove 125*c* may be formed on the outer circumferential surface of the cylinder 140 in contact with the inner circumferential surface of the body portion 121, or formed on both the inner circumferential surface of the body portion 121 and the outer circumferential surface of the cylinder 140.

In addition, a gas inlet 142 corresponding to the gas groove 125*c* may be formed on the outer circumferential surface of the cylinder 140. The gas inlet 142 forms a kind of nozzle in the gas bearing.

The frame 120 and the cylinder 140 may be formed of aluminum or an aluminum alloy material.

The cylinder 140 may be formed in a cylindrical shape that is open at both ends. The piston 150 may be inserted through a rear end of the cylinder 140. A front end of the cylinder 140 may be closed via a discharge valve assembly 170. The compression space 103 may be formed between the cylinder 140, a front end of the piston 150, and the discharge valve assembly 170. Here, the front end of the piston 150 may be referred to as a head portion 151. The compression space 103 increases in volume when the piston 150 moves backward, and decreases in volume as the piston 150 moves forward. That is, the refrigerant introduced into the compression space 103 may be compressed while the piston 150 moves forward, and may be discharged through the discharge valve assembly 170.

The cylinder 140 may include a second flange portion 141 disposed at the front end. The second flange portion 141 may bend to the outside of the cylinder 140. The second flange portion 141 may extend in an outer circumferential direction of the cylinder 140. The second flange portion 141 of the cylinder 140 may be coupled to the frame 120. For example, the front end of the frame 120 may include a flange groove corresponding to the second flange portion 141 of the cylinder 140, and the second flange portion 141 of the cylinder 140 may be inserted into the flange groove and coupled through a coupling member.

A gas bearing means may be provided to supply a discharge gas to a gap between the outer circumferential surface of the piston 150 and the outer circumferential surface of the cylinder 140 and lubricate between the cylinder 140 and the piston 150 with gas. The discharge gas between the cylinder 140 and the piston 150 may provide a floating force to the piston 150 to reduce a friction generated between the piston 150 and the cylinder 140.

For example, the cylinder 140 may include the gas inlet 142. The gas inlet 142 may communicate with the gas groove 125*c* formed on the inner circumferential surface of the body portion 121. The gas inlet 142 may pass through the cylinder 140 in the radial direction. The gas inlet 142 may guide the compressed refrigerant introduced in the gas groove 125*c* between the inner circumferential surface of the cylinder 140 and the outer circumferential surface of the piston 150. Alternatively, the gas groove 125*c* may be formed on the outer circumferential surface of the cylinder 140 in consideration of the convenience of processing.

An entrance of the gas inlet 142 may be formed relatively widely, and an exit of the gas inlet 142 may be formed as a fine through hole to serve as a nozzle. The entrance of the gas inlet 142 may further include a filter (not shown) blocking the inflow of foreign matter. The filter may be a metal mesh filter, or may be formed by winding a member such as fine thread.

The plurality of gas inlets 142 may be independently formed. Alternatively, the entrance of the gas inlet 142 may be formed as an annular groove, and a plurality of exits may be formed along the annular groove at regular intervals. The gas inlet 142 may be formed only at the front side based on the axial middle of the cylinder 140. On the contrary, the gas inlet 142 may be formed at the rear side based on the axial middle of the cylinder 140 in consideration of the sagging of the piston 150.

The piston 150 may reciprocate along the axis inside the cylinder 140. In this regard, the piston 150 is inserted into an open rear end of the cylinder 140 to close the rear of the compression space 103.

The piston 150 may include a head portion 151 and a guide portion 152. The head portion 151 may be formed in a disc shape. The head portion 151 may be partially open. The head portion 151 may partition the compression space 103. The guide portion 152 may extend rearward from an outer circumferential surface of the head portion 151. The guide portion 152 may be formed in a cylindrical shape. The inside of the guide portion 152 may be empty, and a front of the guide portion 152 may be partially sealed by the head portion 151. A rear of the guide portion 152 may be opened and connected to the muffler unit 160. The head portion 151 may be provided as a separate member coupled to the guide portion 152. Alternatively, the head portion 151 and the guide portion 152 may be formed as one body.

The piston 150 may include a suction port 154. The suction port 154 may pass through the head portion 151. The suction port 154 may communicate with the suction space 102 and the compression space 103 inside the piston 150. For example, the refrigerant flowing from the receiving space 101 to the suction space 102 inside the piston 150 may pass through the suction port 154 and may be sucked into the compression space 103 between the piston 150 and the cylinder 140.

The suction port 154 may extend in the axial direction of the piston 150. The suction port 154 may be inclined in the axial direction of the piston 150. For example, the suction port 154 may extend to be inclined in a direction away from the central axis as it goes to the rear of the piston 150.

A cross section of the suction port 154 may be formed in a circular shape. The suction port 154 may have a constant inner diameter. In contrast, the suction port 154 may be formed as a long hole in which an opening extends in the radial direction of the head portion 151, or may be formed such that the inner diameter becomes larger as it goes to the rear.

The plurality of suction ports 154 may be formed in one or more of the radial direction and the circumferential direction of the head portion 151.

The head portion 151 of the piston 150 adjacent to the compression space 103 may be equipped with a suction valve 155 for selectively opening and closing the suction port 154. The suction valve 155 may operate by elastic deformation to open or close the suction port 154. That is, the suction valve 155 may be elastically deformed to open the suction port 154 by the pressure of the refrigerant flowing into the compression space 103 through the suction port 154.

The piston 150 may be connected to a magnet 135. The magnet 135 may reciprocate forward and backward according to the movement of the piston 150. The inner stator 134 and the cylinder 140 may be disposed between the magnet 135 and the piston 150. The magnet 135 and the piston 150 may be connected to each other by a magnet frame 136 that is formed by detouring the cylinder 140 and the inner stator 134 to the rear.

The discharge valve assembly 170 may include a discharge valve 171 and a valve spring 172 that is provided on a front side of the discharge valve 171 to elastically support the discharge valve 171. The discharge valve assembly 170 may selectively discharge the compressed refrigerant in the compression space 103. Here, the compression space 103 means a space between the suction valve 155 and the discharge valve 171.

The discharge valve 171 may be disposed to be supportable on the front surface of the cylinder 140. The discharge valve 171 may selectively open and close the front opening of the cylinder 140. The discharge valve 171 may operate by elastic deformation to open or close the compression space 103. The discharge valve 171 may be elastically deformed to open the compression space 103 by the pressure of the refrigerant flowing into the discharge space 104 through the compression space 103. For example, the compression space 103 may maintain a sealed state while the discharge valve 171 is supported on the front surface of the cylinder 140, and the compressed refrigerant of the compression space 103 may be discharged into an opened space in a state where the discharge valve 171 is spaced apart from the front surface of the cylinder 140.

The valve spring 172 may be provided between the discharge valve 171 and the discharge cover assembly 180 to provide an elastic force in the axial direction. The valve spring 172 may be provided as a compression coil spring, or may be provided as a leaf spring in consideration of an occupied space or reliability.

When the pressure of the compression space 103 is equal to or greater than a discharge pressure, the valve spring 172 may open the discharge valve 171 while deforming forward, and the refrigerant may be discharged from the compression space 103 and discharged into a first discharge space 104*a* of the discharge cover assembly 180. When the discharge of the refrigerant is completed, the valve spring 172 provides a restoring force to the discharge valve 171 and thus can allow the discharge valve 171 to be closed.

A process of introducing the refrigerant into the compression space 103 through the suction valve 155 and discharging the refrigerant of the compression space 103 to the discharge space 104 through the discharge valve 171 is described as follows.

In the process in which the piston 150 linearly reciprocates inside the cylinder 140, if the pressure of the compression space 103 is equal to or less than a predetermined suction pressure, the suction valve 155 is opened and thus the refrigerant is sucked into a compression space 103. On the other hand, if the pressure of the compression space 103 exceeds the predetermined suction pressure, the refrigerant of the compression space 103 is compressed in a state in which the suction valve 155 is closed.

If the pressure of the compression space 103 is equal to or greater than the predetermined suction pressure, the valve spring 172 deforms forward and opens the discharge valve 171 connected to the valve spring 172, and the refrigerant is discharged from the compression space 103 to the discharge space 104 of the discharge cover assembly 180. When the discharge of the refrigerant is completed, the valve spring 172 provides a restoring force to the discharge valve 171 and allows the discharge valve 171 to be closed, thereby sealing a front of the compression space 103.

The discharge cover assembly 180 is installed at the front of the compression space 103, forms a discharge space 104 for receiving the refrigerant discharged from the compression space 103, and is coupled to a front of the frame 120 to thereby reduce a noise generated in the process of discharging the refrigerant from the compression space 103. The discharge cover assembly 180 may be coupled to a front of the first flange portion 122 of the frame 120 while receiving the discharge valve assembly 170. For example, the discharge cover assembly 180 may be coupled to the first flange portion 122 through a mechanical coupling member.

An O-ring 166 may be provided between the discharge cover assembly 180 and the frame 120 to prevent the refrigerant in a gasket 165 for thermal insulation and the discharge space 104 from leaking.

The discharge cover assembly 180 may be formed of a thermally conductive material. Therefore, when a high temperature refrigerant is introduced into the discharge cover assembly 180, heat of the refrigerant may be transferred to the casing 110 through the discharge cover assembly 180 and dissipated to the outside of the compressor.

The discharge cover assembly 180 may include one discharge cover, or may be arranged so that a plurality of discharge covers sequentially communicates with each other. When the discharge cover assembly 180 is provided with the plurality of discharge covers, the discharge space 104 may include a plurality of spaces partitioned by the respective discharge covers. The plurality of spaces may be disposed in a front-rear direction and may communicate with each other.

For example, when there are three discharge covers, the discharge space 104 may include a first discharge space 104*a* between the frame 120 and a first discharge cover 181 coupled to the front side of the frame 120, a second discharge space 104*b* between the first discharge cover 181 and a second discharge cover 182 that communicates with the first discharge space 104*a* and is coupled to a front side of the first discharge cover 181, and a third discharge space 104*c* between the second discharge cover 182 and a third discharge cover 183 that communicates with the second discharge space 104*b* and is coupled to a front side of the second discharge cover 182.

The first discharge space 104*a* may selectively communicate with the compression space 103 by the discharge valve 171, the second discharge space 104*b* may communicate with the first discharge space 104*a*, and the third discharge space 104*c* may communicate with the second discharge space 104*b*. Hence, as the refrigerant discharged from the compression space 103 sequentially passes through the first discharge space 104*a*, the second discharge space 104*b*, and the third discharge space 104*c*, a discharge noise can be reduced, and the refrigerant can be discharged to the outside of the casing 110 through the loop pipe 115*a* and the discharge pipe 115 communicating with the third discharge cover 183.

The linear compressor 100 may include a drive unit 130. The drive unit 130 may be disposed on the outside of the cylinder 140 in a radial direction thereof. The drive unit 130 may include an outer stator 131 disposed between the shell 111 and the frame 120 to surround the body portion 121 of the frame 120, an inner stator 134 dispose between the outer stator 131 and the cylinder 140 to surround the cylinder 140, and a magnet 135 disposed between the outer stator 131 and the inner stator 134.

The outer stator 131 may be coupled to the rear of the first flange portion 122 of the frame 120, and the inner stator 134 may be coupled to the outer circumferential surface of the body portion 121 of the frame 120. The inner stator 134 may be spaced apart from the inside of the outer stator 131, and the magnet 135 may be disposed in a space between the outer stator 131 and the inner stator 134.

The outer stator 131 may be equipped with a winding coil, and the magnet 135 may include a permanent magnet. The permanent magnet may consist of a single magnet with one pole or configured by combining a plurality of magnets with three poles.

The outer stator 131 may include a coil winding 132 surrounding the axial direction in the circumferential direction and a stator core 133 stacked while surrounding the coil winding 132. The coil winding 132 may include a hollow cylindrical bobbin 132*a* and a coil 132*b* wound in a circumferential direction of the bobbin 132*a*. A cross section of the coil 132*b* may be formed in a circular or polygonal shape, for example, may have a hexagonal shape. In the stator core 133, a plurality of lamination sheets may be laminated radially, or a plurality of lamination blocks may be laminated along the circumferential direction.

The drive unit 130 may include the outer stator 131. The outer stator 131 may be formed on the outside of the body portion 121 of the frame 120 in a radial direction thereof. The front of the outer stator 131 may be supported by the first flange portion 122 of the frame 120. The outer stator 131 may be fixed to the first flange portion 122 through a mechanical coupling means. The outer stator 131 may be disposed between the first flange portion 122 and the fixing member 193. The outer stator 131 may be configured such that a plurality of core plates is circumferentially stacked.

The outer stator 131 may include a winding space in which a coil 132*b* may be wound. Specifically, each core plate may be formed in the shape of a ring which is bored in a central portion. If the core plates are circumferentially stacked, the space in which the coil 132*b* may be circumferentially wound around the axis may be formed.

The drive unit 130 may include the inner stator 134. The inner stator 134 may be formed between the body portion 121 of the frame 120 and the outer stator 131. The inner stator 134 may be configured such that the plurality of core plates is circumferentially stacked on the outer circumference of the body portion 121 of the frame 120.

The linear compressor 100 may include a magnet 135 and a magnet frame 136. The magnet frame 136 may have a cylindrical shape, and be disposed to be inserted into the space between the outer stator 131 and the inner stator 134. One side of the magnet 135 may be coupled to and supported on the magnet frame 136. Furthermore, the magnet frame 136 may be coupled to the rear of the piston 150 to move along with the piston 150.

As an example, a rear end of the magnet frame 136 is bent and extended inward in the radial direction to form a first coupling portion 136*a*, and the first coupling portion 136*a* may be coupled to a third flange portion 153 formed in the rear of the piston 150. The first coupling portion 136*a* of the magnet frame 136 and the third flange portion 153 of the piston 150 may be coupled through a mechanical coupling member.

Moreover, a fifth flange portion 162*c* formed in an annular shape along the outside of the inner guide 162 in a radial direction thereof between the third flange portion 153 of the piston 150 and the first coupling portion 136*a* of the magnet frame 136, and a fourth flange portion 161*c* formed on the front of the suction muffler 161 may be disposed. Therefore, the piston 150 may reciprocate linearly while being integrally coupled to the muffler unit 160 and the magnet 135.

When a current is applied to the drive unit 130, a magnetic flux may be formed in the winding coil, and an electromagnetic force may occur by an interaction between the magnetic flux formed in the winding coil of the outer stator 131 and a magnetic flux formed by the permanent magnet of the magnet 135 to move the magnet 135. At the same time as the axial reciprocating movement of the magnet 135, the piston 150 connected to the magnet frame 136 may also reciprocate integrally with the magnet 135 in the axial direction.

The linear compressor 100 may include the elastic body 191. The elastic body 191 may be disposed on the rear of the cylinder 140 in the axial direction thereof. The piston 150 and the magnet frame 136 may be axially and/or radially supported by the elastic body 191. The elastic body 191 may serve as a resonant spring. The elastic body 191 may be a plate spring formed by radially overlapping the plurality of elastic units 1911. That is, in some implementations, the plurality of elastic units 1911 may refer to or include a plurality of elastic plates, respectively.

The elastic body 191 may effectively compress the refrigerant by amplifying vibration realized by the reciprocating motion of the magnet 135 and the piston 150. Specifically, the elastic body 191 may be regulated to a frequency corresponding to the natural frequency of the piston 150 so that the piston 150 may a resonant motion. Furthermore, the elastic body 191 induces the stable movement of the piston 150 to reduce vibration and noise.

The natural frequency of the elastic body 191 may be designed to be the same as the resonant frequency of the magnet 135 and the piston 150 when the linear compressor 100 is operated, thus amplifying the reciprocating motion of the piston 150. Here, since the frame 120 provided as a stator is elastically supported on the casing 110 through the forward support spring 117, the frame may not be fixed, strictly speaking.

Referring to FIGS. 2 to 7, the elastic body 191 may include the plurality of elastic units 1911. The plurality of elastic units 1911 may be circumferentially arranged around the axis. The plurality of elastic units 1911 may have a corresponding shape. The elastic body 191 may have the shape of a disc extending radially around the axis. That is, the elastic body 191 may be understood as a circular plate spring including the plurality of elastic units 1911. Each of the elastic units 1911 may include an elastic portion 1911*a*, an outer portion 1911*b*, and an inner portion 1911*c*. For example, the plurality of elastic units 1911 may be plates having spiral shapes that are assembled to one another and define a circular or annular plate.

The plurality of elastic units 1911 may be formed of three elastic units. Specifically, if eccentricity and/or tilting occurs when the mover, i.e. the piston 150 and the magnet frame 136 axially reciprocate, collision and/or friction may occur between the mover and surrounding components, so that this may have a great effect on the reliability of the linear compressor 100. If the elastic body 191 is formed of two elastic units 1911, the eccentricity and/or tilting in a direction where the two elastic units 1911 are arranged may be alleviated, but there may be a limit to prevent eccentricity and/or tilting in other directions. Furthermore, when the elastic unit 1911 is formed of four or more elastic units, the shape of each elastic unit 1911 is complicated, so that it takes a long time to assembly and/or arrange the elastic units, thus making it difficult to perform a manufacturing process and increasing a manufacturing time. Therefore, the plurality of elastic units 1911 may be preferably formed of three elastic units.

Each of the plurality of elastic units 1911 may include the elastic portion 1911*a*. The elastic portion 1911*a* may be spirally formed while moving away from the axis. Specifically, the elasticity and/or rigidity (N/m) of the elastic body 191 is mainly formed by the elastic portion 1911*a*. The elastic portion 1911*a* requires a length of a predetermined level or more to generate proper elasticity and/or rigidity (N/m). Here, if the elastic portion 1911*a* is spirally formed, the length of the elastic portion 1911*a* may have a predetermined level or more in a limited space in the cylindrical casing 110.

Otherwise, if the length of the elastic portion 1911*a* may have a predetermined level or more, the elastic portion may be formed in various shapes corresponding to the internal space of the casing 110. For example, the elastic portion 1911*a* may be formed in the shape of a rectangular spiral whose side is gradually lengthened as it moves away from the axis, and may be formed in a serpentine shape so that the length of an arc is gradually increased as it moves outwards in a radial direction in a sector.

The width of the elastic portion 1911*a* may be formed to be constant. If stress (MPa) concentrates on a portion of the elastic portion 1911*a*, the elastic body 191 may be damaged in the portion on which the stress MPa concentrates. Therefore, when the piston 150 reciprocates, it is preferable that the stress MPa be evenly distributed on the elastic portion 1911*a*. If the width of a portion of the elastic portion 1911*a* is different from the width of another portion, the stress MPa concentrates on the portion or other portions, so that the elastic body 191 may be damaged. For example, if the width of a portion of the elastic portion 1911*a* is smaller than the width of another portion, the bending moment of the portion increases when the piston 150 reciprocates, so that the stress MPa may concentrate, thus causing defects.

However, without being limited thereto, in order to control the resonant spring or rigidity (N/m) of the elastic body 191, the width of a portion of the elastic portion may be formed to be different from the width of another portion.

Slits 1912 may be formed between the elastic portions 1911*a*. The number of the slits 1912 may be formed to correspond to that of the plurality of elastic units 1911. The slits 1912 may be formed spirally to correspond to the shape of the elastic portion 1911*a*. The width d2 of each slit 1912 may be formed constant. In other words, it is to be understood that the slits 1912 are formed thin between the plurality of elastic portions 1911*a*, and are formed spirally to correspond to the shape of the elastic portion 1911*a*. Furthermore, the widths d2 of the plurality of slits 1912 may correspond to each other.

The width d2 of the slit 1912 may be formed to be 1.5 times as small as the thickness d1 (or axial length) of the elastic body. Conventionally, the distance between the plurality of elastic portions 1911*a* is generally formed to be 1.5 times or more as large as the thickness of the plate spring. However, in the case of the elastic body 191 according to the present disclosure, the width d2 of the slit 1912 may be freely formed even in a range where it is 1.5 times as small as the thickness d1 of the elastic body. By way of example, when the thickness d1 of the elastic body is 2 mm or more, the width d2 of the slit 1912 may be formed between 0.5 mm and 1.5 mm. This will be described later with reference to FIGS. 14 to 16.

In the elastic body 191 according to the first embodiment of the present disclosure, the thickness d1 of the elastic body 191 may be adjusted to obtain a desired rigidity (N/m). Therefore, it is unnecessary to arrange several thin plate springs, and a spacer for separating the plate springs from each other may not be required. Therefore, in the linear compressor 100 including the elastic body 191 according to the first embodiment of the present disclosure, a space occupied by the elastic body 191 in the casing 110 is reduced, thus improving the space efficiency of the internal space of the linear compressor 100.

However, referring to FIGS. 2 to 5, when the thickness d1 of the elastic body may not be manufactured to have a predetermined level or more, or the plurality of elastic bodies 191 is required to remove the eccentricity, the elastic body may be formed of a plurality of bodies. In this case, the linear compressor 100 may include spacers 194*a* and 194*b*.

Each of the elastic units 1911 may include the outer portion 1911*b*. The outer portion 1911*b* may be disposed on the outside of the elastic portion 1911*a* in the radial direction thereof. Referring to FIGS. 7 and 8, the outside of outer dotted lines OD in the radial direction may be the outer portion 1911*b*, while the inside of the outer dotted lines in the radial direction may be the elastic portion 1911*a*. The outer portion 1911*b* may be disposed between the drive unit 130 and the outer portion 1911*b*, and be fixed to the fixing member 193 which is integrally formed circumferentially.

Specifically, the outer coupling member 196*b* may axially pass through the outer portion 1911*b* to be coupled to the fixing member 193 which is disposed on the front of the outer portion 1911*b* in the axial direction thereof. Here, the outer coupling member 196*b* may pass through the fixing member 193 to be coupled to the fastening groove which is formed in the rear end of the bridge 124. The outer coupling member 196*b* may be formed to have a number corresponding to that of the plurality of bridges 124. The outer coupling members 196*b* may be radially arranged around the axis. Each outer coupling member 196*b* may be located to axially overlap the bridge 124.

The plurality of elastic units 1911 may include on respective outer portions 1911*b* thereof a plurality of outer coupling holes 1915 which are circumferentially arranged. Any one of the outer coupling holes 1915 may be disposed to be biased towards the clockwise end of the outer portion 1911*b*, and another one may be disposed to be biased towards the counterclockwise end of the outer portion 1911*b*.

If one outer coupling hole 1915 is formed in each outer portion 1911*b*, it is difficult to secure sufficient durability in a fixing portion, and each elastic unit 1911 may undesirably rotate around the outer coupling hole 1915. However, if the outer coupling hole 1915 is formed of a plurality of holes and is disposed circumferentially to be spaced apart from each other, it is possible to solve the above-mentioned problems. Here, in order to effectively prevent a problem where each elastic unit 1911 rotates, any one of the outer coupling holes 1915 should be disposed to be biased towards the clockwise end of the outer portion 1911*b*, and another one should be disposed to be biased towards the counterclockwise end of the outer portion 1911*b*.

The plurality of outer coupling holes 1915 may be formed in pairs. That is, two outer coupling holes 1915 may be formed in each outer portion 1911*b*. In order to solve a problem where the plurality of elastic units 1911 rotates around the outer coupling hole 1915, only two outer coupling holes 1915 are sufficient. If three or more outer coupling holes 1915 are formed, the number of the corresponding outer coupling members 196*b* may also increase, thus causing an excessive manufacturing cost and making a manufacturing process complicated.

The linear compressor 100 may include an outer coupling member 196*b*. The plurality of elastic units 1911 may be fixed to the fixing member 193 in such a way that the outer coupling member 196*b* passes through the outer coupling hole 1915 to be coupled to the fixing member 193. Here, the outer coupling member 196*b* may be coupled to the fixing member 193 while passing through both an outer spacer 194*a* disposed between the plurality of elastic bodies 191 and an outer rear fixing fame 195*a* disposed on the rear of the elastic body 191 in the axial direction thereof.

Each of the plurality of elastic units 1911 may include an inner portion 1911*c*. The inner portion 1911*c* may be disposed on the inside of the elastic portion 1911*a* in the radial direction thereof. Referring to FIGS. 7 and 8, the inside of inner dotted lines ID in the radial direction may be the inner portion 1911*c*, while the outside of the inner dotted lines in the radial direction may be the elastic portion 1911*a*. The plurality of inner portions 1911*c* may be fixed to the connecting plate 192*a* disposed on the front of the inner portion 1911*c* in the axial direction thereof. Specifically, the inner coupling member 196*a* may pass axially through the inner portion 1911*c* to be coupled to the connecting plate 192*a* disposed on the front of the inner portion 1911*c* in the axial direction thereof.

The linear compressor 100 may include an inner coupling member 196*a*. The plurality of elastic units 1911 may be fixed to the connector 192 in such a way that the inner coupling member 196*a* passes through the inner coupling hole 1916 to be coupled to the connecting plate 192*a*. Here, in the case of forming the plurality of elastic bodies 191, the inner coupling hole 1916 may be coupled to the connecting plate 192*a* while passing through both an inner space 194*b* disposed between the plurality of elastic bodies 191 and an inner rear fixing fame 195*b* disposed on the rear of the elastic body 191 in the axial direction thereof.

The plurality of elastic units 1911 may include a plurality of inner coupling holes 1916 which are circumferentially arranged on each inner portion 1911*c*. Any one of the plurality of inner coupling holes 1916 may be disposed to be biased towards the clockwise end of the inner portion 1911*c*, and another one may be disposed to be biased towards the counterclockwise end of the inner portion 1911*c*.

If one inner coupling hole 1916 is formed in each inner portion 1911*c*, it is difficult to secure sufficient durability in a fixing portion, and each elastic unit 1911 may undesirably rotate around the inner coupling hole 1916. However, if the inner coupling hole 1916 is formed of a plurality of holes and is disposed circumferentially to be spaced apart from each other, it is possible to solve the above-mentioned problems. Here, in order to effectively prevent a problem where each elastic unit 1911 rotates, any one of the inner coupling holes 1916 should be disposed to be biased towards the clockwise end of the inner portion 1911*c*, and another one should be disposed to be biased towards the counterclockwise end of the inner portion 1911*c*.

The plurality of inner coupling holes 1916 may be formed in pairs. That is, two inner coupling holes 1916 may be formed in each inner portion 1911*c*. In order to solve a problem where the plurality of elastic units 1911 rotates around the inner coupling hole 1916, only two inner coupling holes 1916 are sufficient. If three or more inner coupling holes 1916 are formed, the number of the corresponding inner coupling members 196*a* may also increase, thus causing an excessive manufacturing cost and making a manufacturing process complicated.

Meanwhile, specifically, the outer portion 1911*b* and the inner portion 1911*c* may be formed and/or arranged as follows.

Referring to FIGS. 7 and 8, each outer portion 1911*b* may be adjacent to the outer portion 1911*b* of an adjacent elastic unit 1911. Specifically, all the outer edges of the outer portions 1911*b* in the radial direction may be disposed on one outer circumference O. That is, the elastic body 191 may be understood as a disc whose outer edges are formed in a circular shape. Thereby, the alignment and/or arrangement of the plurality of elastic units 1911 are facilitated, and space between the plurality of elastic units 1911 is minimized, so that the loss of the metal plate may be reduced when the elastic body 191 is manufactured, and a process yield may be improved.

An outer boundary portion 1913 may be formed between the outer portions 1911*b* of each of the plurality of elastic units 1911. The outer boundary portion 1913 may be connected to the slit 1912. That is, the outer boundary portion 1913 may be understood as a portion which extends outwards in the radial direction of the spirally formed slit 1912.

Each inner portion 1911*c* may be adjacent to the inner portion 1911*c* of an adjacent elastic unit 1911. Specifically, all the inner edges of the inner portions 1911*c* in the radial direction may be disposed on one inner circumference I. A flow portion 1917 in which the muffler unit 160 may be disposed may be formed on the inside of the inner edge in the radial direction. That is, when viewed from the axial direction, the elastic body 191 may be understood as being formed in the shape of a donut. Thereby, the alignment and/or arrangement of the plurality of elastic units 1911 are facilitated, and space between the plurality of elastic units 1911 is minimized, so that the loss of the metal plate may be reduced when the elastic body 191 is manufactured, and a process yield may be improved. An inner boundary portion 1914 may be formed between the inner portions 1911*c* of each of the plurality of elastic units 1911. The inner boundary portion 1914 may be connected to the slit 1912. That is, the inner boundary portion 1914 may be understood as a portion which extends inwards in the radial direction of the spirally formed slit 1912.

In summary, the elastic body 191 may include the plurality of elastic units 1911, the plurality of elastic units 1911 may have a corresponding shape, and narrow gaps such as the outer boundary portion 1913, the inner boundary portion 1914, and the slit 1912 may be formed between the plurality of elastic units 1911.

Thus, a configuration in which the elastic units 1911 are independent from each other may prevent stress MPa from concentrating on a specific portion, compared to a configuration in which the elastic bodies 191 are integrally formed. This will be described in detail with reference to FIGS. 17 and 18.

Furthermore, since a distance between the elastic units 1911 may be formed to be very narrow compared to the configuration in which the elastic bodies 191 are integrally formed, the performance of the elastic body 191 may be improved. This will be described in detail with reference to FIGS. 14 to 16. Furthermore, if the elastic body 191 is made by cutting one disc, a portion which is lost in the disc may be maximally reduced, and consequently a process yield may be increased.

Meanwhile, in order to maximally reduce the lateral force of the elastic body 191, it is desirable to maximally secure symmetry with respect to the axis. Therefore, it may be important to precisely arrange the plurality of elastic units 1911. Specifically, it may be preferable that the width of the slit 1912 be constant, distances between the plurality of slits 1912 correspond to each other, the outer edges of the plurality of outer portions 1911*b* in the radial direction be disposed on one outer circumference O, and the inner edges of the plurality of inner portions 1911*c* in the radial direction be disposed on one inner circumference I.

Here, since each of the elastic portions 1911*a* is spirally formed, it may not be easy to perform alignment using any one point of the elastic portion 1911*a* as a reference point. Therefore, the outer portion 1911*b* and/or the inner portion 1911*c* may serve as a guide when the elastic units 1911 are arranged. In this case, the outer portion 1911*b* and/or the inner portion 1911*c* may be formed as follows.

When viewed from the axial direction, the shape of the clockwise end of the outer portion 1911*b* of each of the plurality of elastic units 1911 may correspond to the shape of the counterclockwise end of the outer portion 1911*b* of the adjacent elastic unit 1911 in the clockwise direction. Specifically, the clockwise end of the outer portion 1911*b* of each of the elastic units 1911 may be formed in the same shape as that of the counterclockwise end of the outer portion 1911*b* of the adjacent elastic unit 1911 in the clockwise direction. Thereby, when the multiple elastic units 1911 are arranged, it may be easy to identify the distance between the elastic units 1911.

Furthermore, the outer boundary portion 1913 may extend radially outwards from the outer end of the slit 1912. That is, it is to be understood that the slit 1912 is spirally formed, and the outer boundary portion 1913 is bent radially outwards from the outer end of the slit 1912. Moreover, referring to FIG. 7, in a place where the outer boundary portion 1913 meets the outer edge of the elastic body 191, it may be preferable that an angle a between a straight line extending in a direction where the outside of the outer boundary portion 1913 faces, and a tangent line of the outer edge of the elastic body 191 be closer to a right angle. In this case, since it is easy to identify the distance between adjacent outer portions 1911*b* and the radial arrangement of the adjacent outer portions 1911*b*, it may be easy to arrange the plurality of elastic units 1911.

Referring to FIG. 7, when viewed from the axial direction, the outer boundary portion 1913 may be bent radially outwards from the outer end of the slit 1912 and then extend straightly outwards. When both ends of the adjacent outer portions 1911*b* in a circumferential direction thereof are formed straightly, it is possible to easily identify the alignment of the adjacent elastic units 1911, and thus it may be easy to arrange the plurality of elastic units 1911.

However, referring to FIG. 8, unlike shown in FIG. 7, the outer boundary portion 1913 may be formed in a shape in which it is curved round in a direction opposite to a direction in which the spiral shape of the slit 1912 is curved. In this case, an inflection point may be formed in an area where the slit 1912 and the outer boundary portion 1913 meet. That is, it is to be understood that the slit 1912 and the outer boundary portion 1913 are connected to each other, and the slit 1912 and the outer boundary portion 1913 are formed into a single smoothly curved shape. In this case, when the plurality of elastic units 1911 is formed by laser cutting one disc, there is no portion where a laser travel direction changes sharply, so that time required for the laser cutting may be shortened.

Furthermore, if there occurs a portion where the shape of a side edge is sharply bent, in an area of each elastic unit 1911 where the elastic portion 1911*a* and the outer portion 1911*b* meet, stress (MPa) may concentrate on the portion, thus increasing the risk of damage. Therefore, as shown in FIG. 8, if the side edge is formed in a smoothly curved shape in an area of each elastic unit 1911 where the elastic portion 1911*a* and the outer portion 1911*b* meet, stress (MPa) may be evenly distributed and consequently it may be advantageous to improve durability.

Unlike the above-mentioned shape, the outer boundary portion 1913 may be formed such that a middle portion thereof is bent, or be formed in a zigzag shape. That is, as long as the outer boundary portion 1913 has a shape for making it easy to arrange the plurality of elastic units 1911, the outer boundary portion may be formed in various shapes.

Meanwhile, when viewed from the axial direction, the shape of the clockwise end of each inner portion 1911*c* may correspond to the shape of the counterclockwise end of the inner portion 1911*c* of the adjacent elastic unit 1911 in the clockwise direction. Specifically, the clockwise end of each inner portion 1911*c* may be formed in the same shape as that of the counterclockwise end of the inner portion 1911*c* of the adjacent elastic unit 1911 in the clockwise direction. Thereby, when the plurality of elastic units 1911 is arranged, it may be easy to identify a distance between the elastic units 1911.

Furthermore, the inner boundary portion 1914 may extend inwards in the radial direction of the spiral travel direction of the spiral formed by the split 1912 from the inner end of the slit 1912. That is, it is to be understood that the slit 1912 is spirally formed, and the inner boundary portion 1914 is bent inwards in the radial direction of the spiral travel direction of the spiral formed by the split 1912 from the inner end of the slit 1912. Moreover, in a place where the inner boundary portion 1914 and the inner edge of the elastic body 191 meet, it may be preferable that an angle b between a straight line extending in a direction where the inside of the inner boundary portion 1914 faces, and a tangent line of the outer edge of the elastic body 191 be closer to a right angle. In this case, since it is easy to identify the distance between adjacent inner portions 1911*c* and the radial arrangement of the adjacent inner portions 1911*c*, it may be easy to arrange the plurality of elastic units 1911.

Referring to FIG. 7, when viewed from the axial direction, the inner boundary portion 1914 may be bent radially inwards from the inner end of the slit 1912 and then extend straightly inwards. When both ends of the adjacent inner portions 1911*b* in a circumferential direction thereof are formed straightly, it is possible to easily identify the alignment of the adjacent elastic units 1911, and thus it may be easy to arrange the plurality of elastic units 1911.

However, referring to FIG. 8, unlike shown in FIG. 7, the inner boundary portion 1914 may be formed in a shape in which it has a radius smaller than a spiral radius of the inner portion of the slit 1912 and is curved round inwards in the radial direction. That is, it is to be understood that the slit 1912 and the inner boundary portion 1914 are connected to each other, the slit 1912 and the inner boundary portion 1914 are bent in the same direction, and the inner boundary portion 1914 is formed in a curved shape where it is further bent at the inner end of the slit 1912. Furthermore, it is to be understood that the slit 1912 and the inner boundary portion 1914 are formed into a single smoothly curved shape. In this case, when the plurality of elastic units 1911 is formed by laser cutting one disc, there is no portion where a laser travel direction changes sharply, so that time required for the laser cutting may be shortened.

Furthermore, if there occurs a portion where the shape of a side edge is sharply bent, in an area of each elastic unit 1911 where the elastic portion 1911*a* and the inner portion 1911*c* meet, stress (MPa) may concentrate on the portion, thus increasing the risk of damage. Therefore, as shown in FIG. 8, if the side edge is formed in a smoothly curved shape in an area of each elastic unit 1911 where the elastic portion 1911*a* and the inner portion 1911*c* meet, stress (MPa) may be evenly distributed and consequently it may be advantageous to improve durability.

Unlike the above-mentioned shape, the inner boundary portion 1914 may be formed such that a middle portion thereof is bent, or be formed in a zigzag shape. That is, as long as the inner boundary portion 1914 has a shape for making it easy to arrange the plurality of elastic units 1911, the outer boundary portion may be formed in various shapes.

Meanwhile, the plurality of elastic units 1911 may be separately manufactured and then assembled, and may be formed by radiating laser onto one disc along the slit 1912, the outer boundary portion 1913, and the inner boundary portion 1914. Here, in the case of making the elastic body 191 through the latter method, the loss of the metal plate which is the material of the elastic body 191 may be minimally reduced, thus increasing manufacturing efficiency. Therefore, if a method of manufacturing the elastic body 191 using the laser cutting process is improved, the loss of the material may be reduced, and the process yield may also be increased. To this end, the outer boundary portion 1913 and the inner boundary portion 1914 may be formed as follows.

The width d3 of the outer boundary portion 1913 may correspond to the width d2 of the slit 1912. Furthermore, the width d4 of the inner boundary portion 1914 may correspond to the width d2 of the slit 1912. That is, the width d3 of the outer boundary portion 1913 may be the same as the width d2 of the slit 1912, and the width d4 of the inner boundary portion 1914 may be the same as the width d2 of the slit 1912. In this case, the laser may cut the disc while passing from the inside in the radial direction sequentially through the inner boundary portion 1914, the slit 1912, and the outer boundary portion 1913, and may cut the disc while passing from the outside in the radial direction sequentially through the outer boundary portion 1913, the slit 1912, and the inner boundary portion 1914. It is to be understood that the width d2 of the slit 1912, the width d3 of the outer boundary portion 1913, and the width d4 of the inner boundary portion 1914 correspond to the width of radiated laser.

If any one of the inner boundary portion 1914, the slit 1912, and the outer boundary portion 1913 has a different width, it may be difficult for the laser to perform the cutting operation while passing through the inner boundary portion 1914, the slit 1912, and the outer boundary portion 1913 at once. The reason is because laser having a separately set intensity and thickness should be radiated onto a portion having a different width. Therefore, in order to increase the ease of manufacture and shorten a manufacturing time, when the elastic body 191 according to the first embodiment of the present disclosure is manufactured, it may be preferable that the width d3 of the outer boundary portion 1913 and the width d4 of the inner boundary portion 1914 correspond to the width d2 of the slit 1912.

In summary, the shape of each of the plurality of elastic units 1911 may be formed to correspond to the shape of space between the elastic units 1911 disposed on both sides, the outer circumference O, and the inner circumference I. Furthermore, it is to be understood that each of the elastic units 1911 is arranged and assembled in the space between the adjacent elastic units 1911 in the shape of a puzzle Thereby, the plurality of elastic units 1911 may be densely disposed on a plane to maximize the process yield and the space efficiency of the inner space of the linear compressor 100, and simultaneously improve the performance of the elastic body 191.

The linear compressor 100 may include a connector 192. The connector 192 may connect the piston 150 and the elastic body 191. The connector 192 may include a disc-shaped plate 192*a* (or connecting plate 192*a*) extending in the radial direction, and a rod 192*b* extending forwards in the axial direction from the central area of the connecting plate 192*a*. The rod 192*b* and the connecting plate 192*a* may be integrally formed.

The connector 192 may include the connecting plate 192*a*. The connecting plate 192*a* may be disposed on the front of the inner portion 1911*c* of the elastic body 191 in the axial direction. Specifically, the connecting plate 192*a* may be disposed between the elastic body 191 and the piston 150. The connecting plate 192*a* may be formed in the shape of a disc. The inner portion 1911*c* may be fixed to the connecting plate 192*a* by the inner coupling member 196*a*.

The connecting plate 192*a* may include a ring portion 192*aa* and a plurality of ribs 192*ab*. The ring portion 192*aa* may overlap the front of the inner portion 1911*c* in the axial direction, and be formed in the shape of a ring which is circumferentially formed. Each of the ribs 192*ab* may connect a second end of the rod 192*b* and the ring portion 192*aa*. That is, the plurality of ribs 192*ab* may serves as a structure for connecting the ring portion 192*aa* and the rod 192*b*.

Referring to FIG. 6, the plurality of ribs 192*ab* may be formed in a number corresponding to the number of the plurality of elastic units 1911. That is, the plurality of ribs 192*ab* may be formed in the same number as that of the plurality of elastic units 1911. Furthermore, the outer end of each of the ribs 192*ab* may be connected to the ring portion 192*aa* in the central area of the inner portion 1911*c* in the circumferential direction.

Specifically, the elastic force of the elastic portion 1911*a* may be transmitted to the inner portion 1911*c* and the ring portion 192*aa* coupled to the inner portion 1911*c*, the elastic force transmitted to the ring portion 192*aa* may be transmitted through the rib 192*ab* to the rod 192*b*, and the elastic force transmitted to the rod 192*b* may be transmitted through the rod 192*b* to the piston 150. Here, if the outer end of the rod 192*b* is connected to the ring portion 192*aa* in the central area of the inner portion 1911*c* in the circumferential direction, the elastic force of the elastic body 191 may be effectively transmitted to the rod 192*b*.

Furthermore, if the outer end of the rod 192*b* is connected to the ring portion 192*aa* in an area where the inner boundary portion 1914 formed between the plurality of inner portions 1911*c* is disposed, the connecting plate 192*a* may be damaged due to distortion caused by a slight difference in moving direction of the plurality of elastic units 1911. Therefore, it may be preferable that the outer end of each of the plurality of ribs 192*ab* be connected to the ring portion 192*aa* in the central area of the inner portion 1911*c* in the circumferential direction.

Unlike shown in FIG. 6, the outer end of each of the plurality of ribs 192*ab* may be connected to the ring portion 192*aa* in an area where the inner boundary portion 1914 is formed. Specifically, since adjacent inner portions 1911*c* are separated from each other on the basis of the inner boundary portion 1914, stress (MPa) applied to the inner boundary portion 1914 may be smaller than stress (MPa) acting on the central area of the inner portion 1911*c* in the circumferential direction thereof. Therefore, if the outer end of each of the plurality of ribs 192*ab* is connected to the ring portion 192*aa* in an area where the inner boundary portion 1914 is formed, it may be less affected by the stress (MPa) acting on the inner portion 1911*c* and thereby bending moment applied to the plurality of ribs 192*ab* may be reduced.

The connecting plate 192*a* may include flow holes 192*ac* formed between the rib 192*ab* and the ring portion 192*aa*. It is to be understood that the flow holes 192*ac* are formed in a number corresponding to that of the ribs 192*ab*. The flow hole 192*ac* may be formed in the shape of a sector. An inner path 162*b* of the muffler unit 160 may be disposed in the flow hole 192*ac*. That is, the refrigerant introduced into the muffler unit 160 from the rear in the axial direction may be guided into the piston 150 through the inner path 162*b* disposed in the flow hole 192*ac*.

The connecting plate 192*a* may include a first protruding portion 192*ad*. The first protruding portion 192*ad* may protrude rearwards in the axial direction from the rear of the ring portion 192*aa* in the axial direction. The first protruding portion 192*ad* may be formed in a number corresponding to that of the inner boundary portions 1914. The width of the first protruding portion 192*ad* may correspond to the width d4 of the inner boundary portion 1914. Specifically, when the plurality of inner portions 1911*c* are coupled to the ring portion 192*aa* of the connecting plate 192*a*, the first protruding portion 192*ad* may serve as a jig to guide the fixing position of the inner portion 1911*c*.

Figure 9:
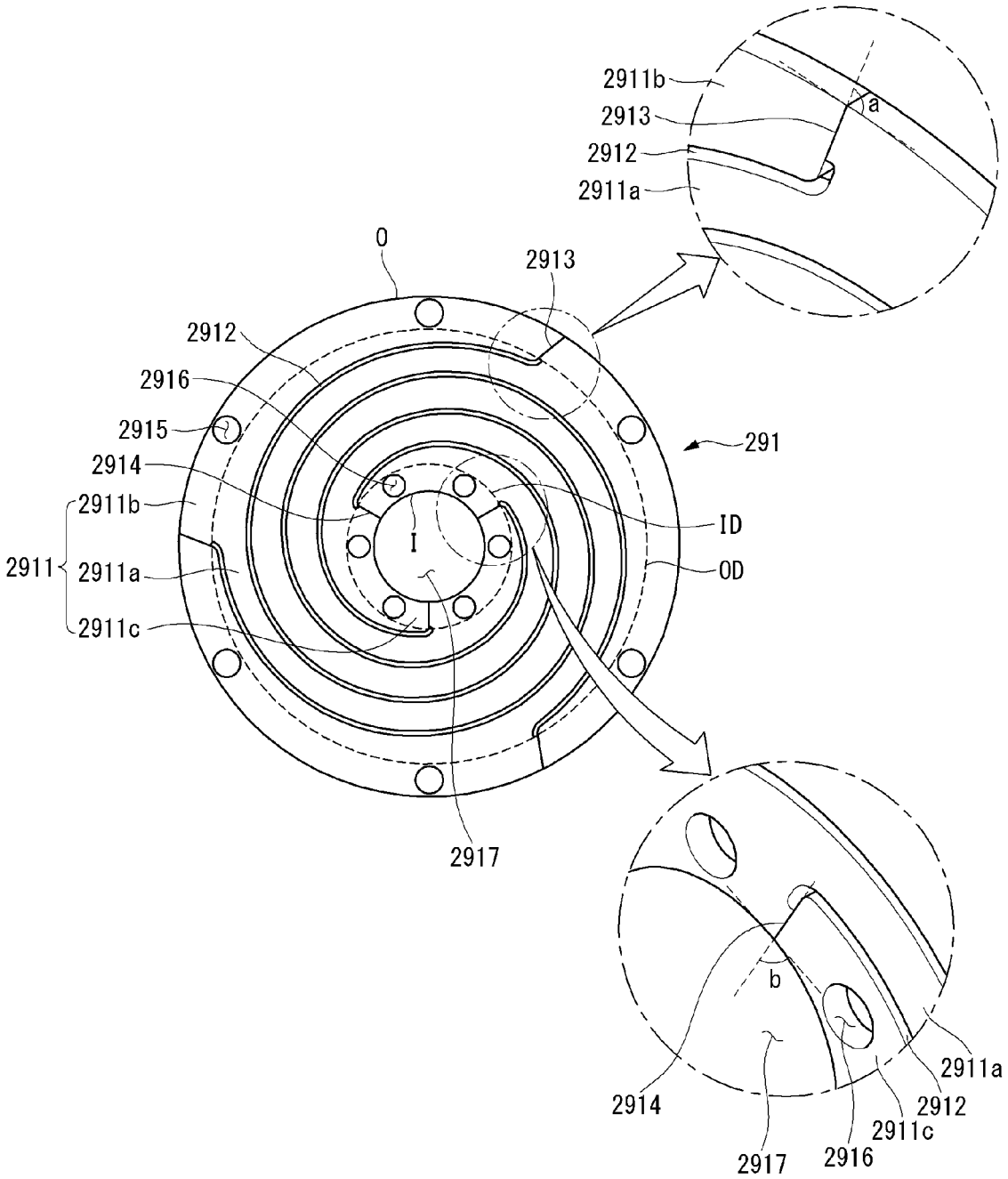
FIG. 9 illustrates an elastic body in accordance with a third embodiment of the present disclosure in a front view and a partial perspective view.
Figure 10:
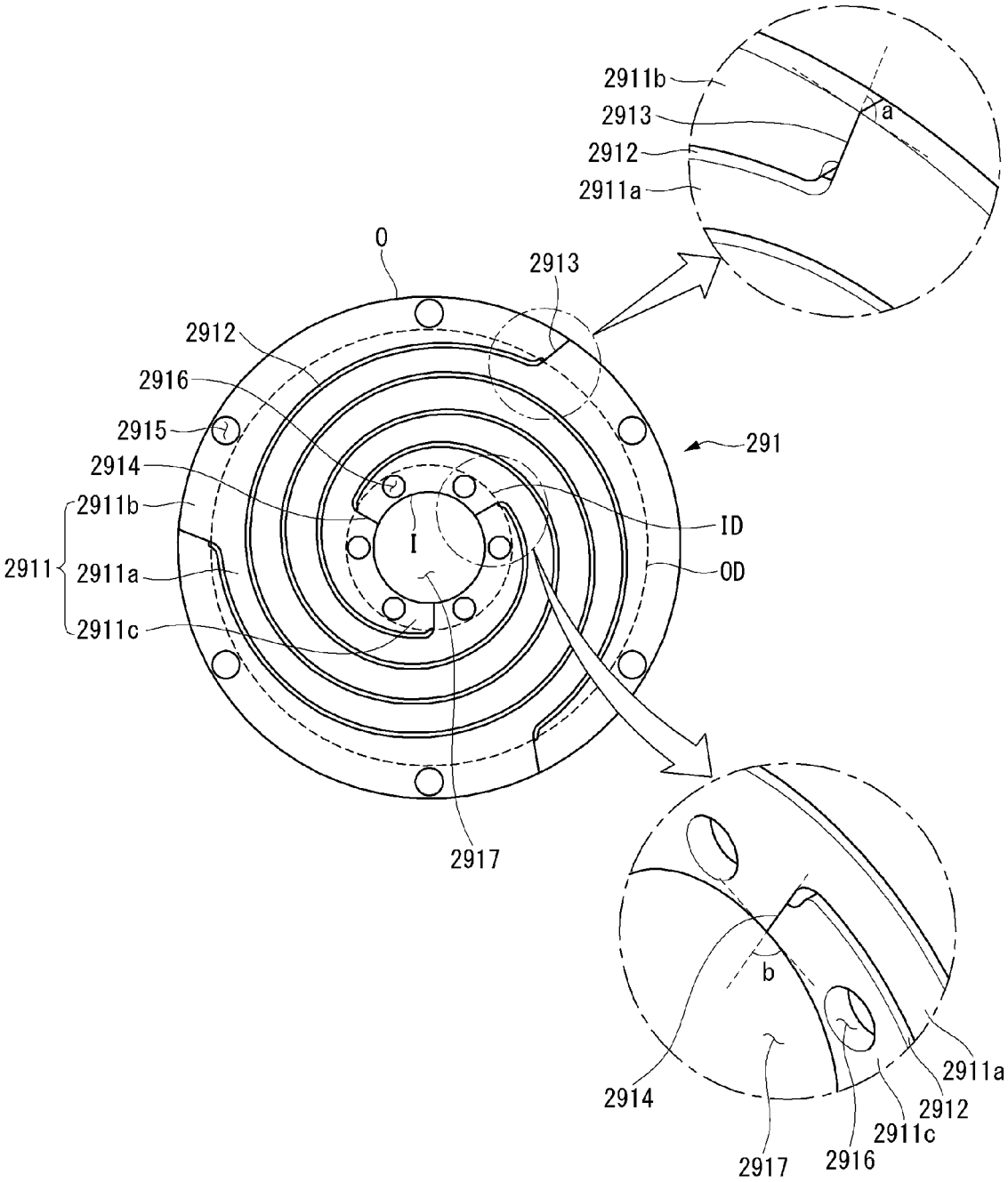
FIG. 10 illustrates an elastic body in accordance with a fourth embodiment of the present disclosure in a front view and a partial perspective view.

Otherwise, as shown in FIGS. 9 and 10, when the inner portions 1911*c* come into contact with each other, the first protruding portion 192*ad* may not be formed. Furthermore, even if the inner portions 1911*c* are spaced apart from each other, the first protruding portion 192*ad* may not be formed if it is possible to easily align the inner portions 1911*c* on the connecting plate 192*a* and a fixing force is sufficient.

The connector 192 may include the rod 192*b*. The rod 192*b* may be disposed in the piston 150. The rod 192*b* may extend axially. The rod 192*b* may prevent the piston 150 from being tilted in the cylinder 140.

The rod 192*b* may be coupled at a first end thereof to the piston 150. Specifically, the first end of the rod 192*b* may be disposed in the central area of a head portion 151 of the piston 150 in the radial direction. The piston 150 and the rod 192*b* may share the same axis. A rod groove (not shown) to which the first end of the rod 192*b* may be coupled may be formed in the rear surface of the head portion 151. However, unlike shown in FIG. 2, the first end of the rod 192*b* may be fixed to an intake valve 155 through the head portion 151.

The second end of the rod 192*b* may be coupled to the central area of the connecting plate 192*a* in the radial direction thereof. The rod 192*b* may be formed integrally with the connecting plate 192*a*. The plurality of ribs 192*ab* may extend radially outwards from the second end of the rod 192*b*.

The rod 192*b* may be formed of an elastic material. Therefore, the piston 150 may secure flexibility in a direction where it is inclined with respect to the first end of the rod 192*b*, and the piston 150 may maintain axial alignment in the cylinder 140 by a gas bearing even if other structures connected to the piston 150 are axially misaligned. That is, it is possible to effectively prevent the piston 150 from being tilted about an axis.

The linear compressor 100 may include the fixing member 193. The fixing member 193 may be disposed between the drive unit 130 and the outer portion 1911*b*. The fixing member 193 may be integrally formed in the circumferential direction. That is, this may be understood as having the shape of a ring which is circumferentially formed about the axis. The outer portion 1911*b* may be fixed to the fixing member 193. The front surface of the fixing member 193 in the axial direction may be in close contact with the rear surface of the outer stator 131.

The thickness of an area of the fixing member 193 to which the outer coupling member 196*b* is coupled may be formed to be thicker than other portions. Specifically, the outer portion 1911*b* of the elastic body 191 is coupled to the bridge 124 and the fixing member 193 that is the stator. Here, the fixing member 193 should have durability sufficient to withstand the vibration of the elastic body 191. Particularly, since a portion of the fixing member 193 to which the outer fixing member 193 is coupled may have the lowest durability, it may be preferable that a portion of the fixing member 193 to which the outer coupling member 196*b* is coupled be formed thicker. Furthermore, a distance between the drive unit 130 and the elastic body 191 may be adjusted through the thick portion of the fixing member 193.

Otherwise, if the durability of the fixing member 193 may be sufficiently attained and a separate member (e.g. stator cover or the like) for adjusting the distance between the outer stator 131 and the fixing member 193 is disposed, the fixing member 193 may be formed to have a predetermined thickness.

The fixing member 193 may include a second protruding portion 193*a*. The second protruding portion 193*a* may protrude rearwards in the axial direction from the rear surface of the fixing member 193 in the axial direction. The second protruding portion 193*a* may be formed in a number corresponding to that of the outer boundary portions 1913. The width of the second protruding portion 193*a* may correspond to the width d3 of the outer boundary portion 1913. Specifically, when the plurality of outer portions 1911*b* is coupled to the fixing member 193, the second protruding portion 193*a* may serve as a jig to guide the fixing position of the outer portion 1911*b*.

Otherwise, as shown in FIGS. 9 and 10, when the outer portions 1911*b* come into contact with each other, the second protruding portion 193*a* may not be formed. Furthermore, even if the outer portions 1911*b* are spaced apart from each other, the second protruding portion 193*a* may not be formed if it is possible to easily align the outer portions 1911*b* on the connecting plate 192*a* and a fixing force is sufficient.

The linear compressor 100 may include spacers 194*a* and 194*b*. Since the elastic body 191 according to the first embodiment of the present disclosure may freely adjust the thickness of the elastic body 191 itself, sufficient rigidity (N/m) may be attained using only one elastic body 191. However, otherwise, when the thickness d1 of the elastic body may not be manufactured to have a predetermined level or more, the plurality of elastic bodies 191 may be axially arranged. In this case, the spacers 194*a* and 194*b* may be disposed between the plurality of elastic bodies 191.

Specifically, if the multiple elastic bodies 191 axially come into close contact with each other, a loss may occur due to friction in a contact surface between both elastic bodies 191 when the piston 150 axially reciprocates. The friction may reduce the efficiency of the linear compressor 100. Therefore, when the multiple elastic bodies 191 are axially arranged, the spacers 194*a* and 194*b* may be disposed between the elastic bodies 191 to make the elastic bodies 191 be spaced apart from each other.

The spacers 194*a* and 194*b* may include an outer spacer 194*a* and an inner spacer 194*b*. The outer spacer 194*a* and the inner spacer 194*b* each may have the shape of a ring which is integrally formed in a circumferential direction around the axis.

The outer spacer 194*a* may be disposed to axially overlap the outer portion 1911*b*. In the multiple elastic bodies 191, the outer coupling member 196*b* may pass axially through each outer portion 1911*b* to be coupled to the fixing member 193. Here, the outer spacer 194*a* may also be fixed together by the outer coupling member 196*b*.

The inner spacer 194*b* may be disposed to axially overlap the inner portion 1911*c*. In the multiple elastic bodies 191, the inner coupling member 196*a* may pass axially through each inner portion 1911*c* to be coupled to the connecting plate 192*a* of the connector 192. Here, the inner spacer 194*b* may also be fixed together by the inner coupling member 196*a*.

The inner spacer 194*b* may include a fourth protruding portion 194*ba*. The fourth protruding portion 194*ba* may protrude rearwards in the axial direction from the rear surface of the inner spacer 194*b* in the axial direction. The fourth protruding portion 194*ba* may be formed in a number corresponding to that of the inner boundary portion 1914. The width of the fourth protruding portion 194*ba* may correspond to the width d3 of the outer boundary portion 1913. Specifically, when the plurality of outer portions 1911*b* is coupled to the inner spacer 194*b*, the fourth protruding portion 194*ba* may serve as a jig to guide the fixing position of the inner portion 1911*c*.

Otherwise, as shown in FIGS. 9 and 10, when the inner portions 1911*c* come into contact with each other, the fourth protruding portion 194*ba* may not be formed. Furthermore, even if the inner portions 1911*c* are spaced apart from each other, the fourth protruding portion 194*ba* may not be formed if it is possible to easily align the outer portions 1911*b* on the connecting plate 192*a* and a fixing force is sufficient.

The outer spacer 194*a* may include the third protruding portion 194*aa*. The third protruding portion 194*aa* may protrude rearwards in the axial direction from the rear surface of the outer spacer 194*a* in the axial direction. The third protruding portion 194*aa* may be formed in a number corresponding to that of the outer boundary portions 1913. The width of the third protruding portion 194*aa* may correspond to the width d3 of the outer boundary portion 1913. Specifically, when the plurality of outer portions 1911*b* is coupled to the outer spacer 194*a*, the third protruding portion 194*aa* may serve as a jig to guide the fixing position of the inner portion 1911*c*.

Otherwise, as shown in FIGS. 9 and 10, when the outer portions 1911*b* come into contact with each other, the third protruding portion 194*aa* may not be formed. Furthermore, even if the outer portions 1911*b* are spaced apart from each other, the third protruding portion 194*aa* may not be formed if it is possible to easily align the outer portions 1911*b* on the connecting plate 192*a* and a fixing force is sufficient.

The linear compressor 100 may include rear fixing fames 195*a* and 195*b*. The rear fixing fames 195*a* and 195*b* may be disposed on the rear of the elastic body 191 in the axial direction. The rear fixing fames 195*a* and 195*b* may serve to stably fix the elastic body 191 on the rear of the elastic body 191.

The rear fixing fames 195*a* and 195*b* may serve as a washer, when the outer coupling member 196*b* and the inner coupling member 196*a* pass through the elastic body 191 to be coupled thereto. When the coupling member passes directly through the elastic body 191 to be coupled to the fixing member 193 without the rear fixing fames 195*a* and 195*b*, stress (MPa) may concentrate on a place where the coupling member and the elastic body 191 meet. However, if the ring-shaped rear fixing fames 195*a* and 195*b* are disposed, the stress (MPa) concentrating on the coupling member may be evenly distributed along a circumference, so that the durability of the elastic body 191 may be improved.

The rear fixing fames 195*a* and 195*b* may include an outer rear fixing fame 195*a* and an inner rear fixing fame 195*b*. The outer rear fixing fame 195*a* and the inner rear fixing fame 195*b* may be integrally formed in the circumferential direction around the axis.

The outer rear fixing fame 195*a* may be disposed on the rear of the outer portion 1911*b* in the axial direction. When the outer portion 1911*b* is penetrated by the outer coupling member 196*b* to be fixed to the fixing member 193, the outer rear fixing fame 195*a* may also be penetrated by the outer coupling member 196*b* to be fixed to the fixing member 193.

The inner rear fixing fame 195*b* may be disposed on the rear of the inner portion 1911*c* in the axial direction. When the inner portion 1911*c* is penetrated by the inner coupling member 196*a* to be fixed to the connecting plate 192*a*, the inner rear fixing fame 195*b* may also be penetrated by the inner coupling member 196*a* to be fixed to the connecting plate 192*a*.

Unlike the elastic body 191 according to the first embodiment of the present disclosure, the elastic body 191 may be a coil spring extending axially. Both ends of the resonant spring 118 may be connected, respectively, to a vibrating body and a fixing body. For example, the first end of the resonant spring 118 may be connected to the magnet frame 136, and the second end thereof may be connected to a back cover (not shown). Thus, the resonant spring 118 may be elastically deformed between a vibrating mover connected to the first end of the spring and a stator fixed to the second end thereof.

The linear compressor 100 may include the muffler unit 160. The muffler unit 160 may be coupled to the rear of the piston 150 to attenuate noise generated while the refrigerant is sucked into the piston 150. The refrigerant sucked through the intake pipe 114 may flow through the muffler unit 160 into the suction space 102 defined in the piston 150.

The muffler unit 160 may include a suction muffler 161 communicating with a receiving space 101 of the casing 110, and an inner guide 162 coupled to the front of the suction muffler 161 to guide the refrigerant to the intake port 154.

The suction muffler 161 may be disposed on the rear of the piston 150. The suction muffler 161 may be disposed in the flow portion 1917 formed on the inside of the inner portion 1911*c* in the radial direction. A rear opening of the suction muffler 161 may be disposed adjacent to the intake pipe 114, and a front end thereof may be coupled to the rear of the piston 150. The suction muffler 161 may have an axial path to guide the refrigerant in the receiving space 101 to the suction space 102 defined in the piston 150.

The suction muffler 161 may include a first suction muffler 161*a* and a second suction muffler 161*b*. A front of each of the first suction muffler 161*a* and the second suction muffler 161*b* in the axial direction may be opened. The second suction muffler 161*b* may be press-fitted into the front of the first suction muffler 161*a*, and be disposed in the first suction muffler 161*a*. Such a structure allows the interior of the suction muffler 161 to have a plurality of noise spaces which are partitioned by a baffle. Furthermore, the suction muffler 161 may be formed of a plastic material in consideration of weight or insulating performance.

The first suction muffler 161*a* may include a fourth flange portion 161*c*. The fourth flange portion 161*c* may be formed on the front end of the first suction muffler 161*a* in the axial direction to extend outwards in the radial direction. The fourth flange portion 161*c* of the suction muffler 161 may be fixed between the piston 150 and the first coupling portion 136*a* of the magnet frame 136 to axially reciprocate along with the piston 150.

A groove portion 161*aa* in which the rib 192*ab* of the connecting plate 192*a* may be disposed may be included in the front end of the first suction muffler 161*a*. Specifically, the first suction muffler 161*a* may pass through the connecting plate 192*a* in back of the connecting plate 192*a* to be coupled to the piston 150. Here, the first suction muffler 161*a* may pass through the connecting plate 192*a* such that an outer circumference thereof is disposed inside the ring portion 192*aa*. In this case, since the first suction muffler 161*a* interferes with the rib 192*ab* of the connecting plate 192*a*, the groove portion 161*aa* in which the rib 192*ab* may be seated may be formed in the front of the first suction muffler 161*a*. The groove portion 161*aa* may be formed in a number corresponding that of the rib 192*ab*.

The muffler unit 160 may include the inner guide 162. A first side of the inner guide 162 may communicate with the noise space of the suction muffler 161, and a second side thereof may be inserted deeply into the piston 150. The inner guide 162 may include a path fixing portion 162*a* coming into close contact with the front end of the second suction muffler 161*b*, and an inner path 162*b* extending forwards from the path fixing portion 162*a*. The path fixing portion 162*a* and the inner path 162*b* may be integrally formed.

The inner guide 162 may include the path fixing portion 162*a*. The path fixing portion 162*a* may be the shape of a disc formed in a radial direction. The path fixing portion 162*a* may serve as a guide which fixes the locations of a plurality of inner paths 162*b*, and disposes the rear ends of the plurality of inner paths 162*b* in the axial direction into the suction muffler 161.

Specifically, the rear surface of the path fixing portion 162*a* in the axial direction may be disposed to be in close contact with the front end of the second suction muffler 161*b*. The radial length of the path fixing portion 162*a* may correspond to the radius of the inner circumference of the first suction muffler 161*a*. That is, it is to be understood that the inner guide 162 is inserted into the front of the suction muffler 161, and the rear surface of the path fixing portion 162*a* in the axial direction, which is the rear end of the inner guide 162 in the axial direction, comes into close contact with the front end of the second suction muffler 161*b*.

A portion of the path fixing portion 162*a* to which the inner path 162*b* is connected may be opened. The opened portion of the path fixing portion 162*a* may be formed in a shape corresponding to the sectional shape of the inner path 162*b*. Therefore, the refrigerant introduced into the rear end of the suction muffler 161 in the axial direction may pass through the opened portion of the path fixing portion 162*a* to flow into the inner path 162*b*.

The inner guide 162 may include the inner path 162*b*. The inner path 162*b* may extend axially forwards from the path fixing portion 162*a*. The inner path 162*b* may be formed of a plurality of inner paths. Specifically, each inner path 162*b* may be disposed inside the flow hole 192*ac* of the connector 192. Here, the inner paths 162*b* may be formed in a number corresponding to that of the plurality of flow holes 192*ac* formed in the connector 192.

Each inner path 162*b* may be formed in the shape of a sector. Specifically, the inner path 162*b* may be disposed in a remaining area of the flow hole 192*ac* except for an area in which the first suction muffler 161*a* is disposed. Here, since the flow hole 192*ac* may be formed in the shape of a sector and the first suction muffler 161*a* is circumferentially formed along the inner circumference of the ring portion 192*aa* in the flow hole 192*ac*, space in which the inner path 162*b* may be disposed may also have the shape of a sector. In this case, if a gap is formed between the flow hole 192*ac* and the outer circumference of the inner path 162*b*, the refrigerant may flow out through the gap. This may affect the efficiency of the linear compressor 100. Therefore, it may be preferable that the sectional shape of the inner path 162*b* correspond to the shape of the space in which the inner path 162*b* may be disposed.

The inner guide 162 may be seated on the connecting plate 192*a* in such a way that the plurality of inner paths 162*b* is introduced into the plurality of flow holes 192*ac* in the back of the connecting plate 192*a*. Here, when viewed from the axial direction, the plurality of inner paths 162*b* may be radially disposed around the rod 192*b*.

In terms of the refrigerant, the refrigerant may flow from the rear end of the suction muffler 161 in the axial direction into the suction muffler 161, and the introduced refrigerant may pass sequentially through the second suction muffler 161*b*, the path fixing portion 162*a*, and the inner path 162*b* to be introduced into the space defined in the piston 150. That is, in spite of the radially formed elastic body 191 and plate 192*a*, the muffler unit 160 may allow the refrigerant to smoothly flow axially without interference between the elastic body 191 and the connecting plate 192*a*.

The inner guide 162 may include a fifth flange portion 162*c*. The fifth flange portion 162*c* may have the shape of a ring which is circumferentially formed around the axis. The fifth flange portion 162*c* may be disposed on the outside of the inner path 162*b* in the radial direction to surround all of the plurality of inner paths 162*b*. The fifth flange portion 162*c* may be axially fixed between the piston 150 and the fourth flange portion 161*c* so that the inner guide 162 may axially reciprocate along with the piston 150.

In summary, the outer portion 1911*b* of the elastic body 191 is secured to the frame 120 that is the stator, while the inner portion 1911*c* is secured to the piston 150 that is the mover by the connector 192. Therefore, when the piston 150 moves axially, the outer portion 1911*b* may be fixed, and the inner portion 1911*c* may axially reciprocate to correspond to the axial reciprocating motion of the piston 150.

Here, through a structure where the fifth flange portion 162*c* of the inner guide 162 and the fourth flange portion 161*c* of the suction muffler 161 are disposed between the piston 150 and the first coupling portion 136*a* of the magnet frame 136 coupled to the rear end of the piston 150, the muffler unit 160 may be coupled to the piston 150, and the muffler unit 160 may axially reciprocate to correspond to the axial reciprocating motion of the piston 150. That is, components performing the axial reciprocating motion may be understood as being the piston 150, the connector 192, the inner portion 1911*c*, the muffler unit 160, and the magnet frame 136.

The linear compressor 100 may include a plurality of sealing members that can increase a coupling force between the frame 120 and the components around the frame 120.

For example, the plurality of sealing members may include a first sealing member that is interposed at a portion where the frame 120 and the discharge cover assembly 180 are coupled and is inserted into an installation groove provided at the front end of the frame 120, and a second sealing member that is provided at a portion at which the frame 120 and the cylinder 140 are coupled and is inserted into an installation groove provided at an outer surface of the cylinder 140. The second sealing member can prevent the refrigerant of the gas groove 125*c* between the inner circumferential surface of the frame 120 and the outer circumferential surface of the cylinder 140 from leaking to the outside, and can increase a coupling force between the frame 120 and the cylinder 140. The plurality of sealing members may further include a third sealing member that is provided at a portion at which the frame 120 and the inner stator 134 are coupled and is inserted into an installation groove provided at the outer surface of the frame 120. Here, the first to third sealing members may have a ring shape.

An operation of the linear compressor 100 described above is as follows.

First, when a current is applied to the drive unit 130, a magnetic flux may be formed in the outer stator 131 by the current flowing in the coil 132*b*. The magnetic flux formed in the outer stator 131 may generate an electromagnetic force, and the magnet 135 including the permanent magnet may linearly reciprocate by the generated electromagnetic force. The electromagnetic force is generated in a direction (forward direction) in which the piston 150 is directed toward a top dead center (TDC) during a compression stroke, and is alternately generated in a direction (rearward direction) in which the piston 150 is directed toward a bottom dead center (BDC) during a suction stroke. That is, the drive unit 130 may generate a thrust which is a force for pushing the magnet 135 and the piston 150 in a moving direction.

The piston 150 linearly reciprocating inside the cylinder 140 may repeatedly increase or reduce volume of the compression space 103.

When the piston 150 moves in a direction (rearward direction) of increasing the volume of the compression space 103, a pressure of the compression space 103 may decrease. Hence, the suction valve 155 mounted in front of the piston 150 is opened, and the refrigerant remaining in the suction space 102 may be sucked into the compression space 103 along the suction port 154. The suction stroke may be performed until the piston 150 is positioned in the bottom dead center by maximally increasing the volume of the compression space 103.

The piston 150 reaching the bottom dead center may perform the compression stroke which switching its motion direction and moving in a direction (forward direction) of reducing the volume of the compression space 103. As the pressure of the compression space 103 increases during the compression stroke, the sucked refrigerant may be compressed. When the pressure of the compression space 103 reaches a setting pressure, the discharge valve 171 is pushed out by the pressure of the compression space 103 and is opened from the cylinder 140, and the refrigerant can be discharged into the discharge space 104 through a separation space. The compression stroke can continue while the piston 150 moves to the top dead center at which the volume of the compression space 103 is minimized.

As the suction stroke and the compression stroke of the piston 150 are repeated, the refrigerant introduced into the receiving space 101 inside the linear compressor 100 through the suction pipe 114 may be introduced into the suction space 102 inside the piston 150 by sequentially passing the suction guide 116*a*, the suction muffler 161, and the inner guide 162, and the refrigerant of the suction space 102 may be introduced into the compression space 103 inside the cylinder 140 during the suction stroke of the piston 150. After the refrigerant of the compression space 103 is compressed and discharged into the discharge space 104 during the compression stroke of the piston 150, the refrigerant may be discharged to the outside of the linear compressor 100 via the loop pipe 115*a* and the discharge pipe 115.

Figure 11:
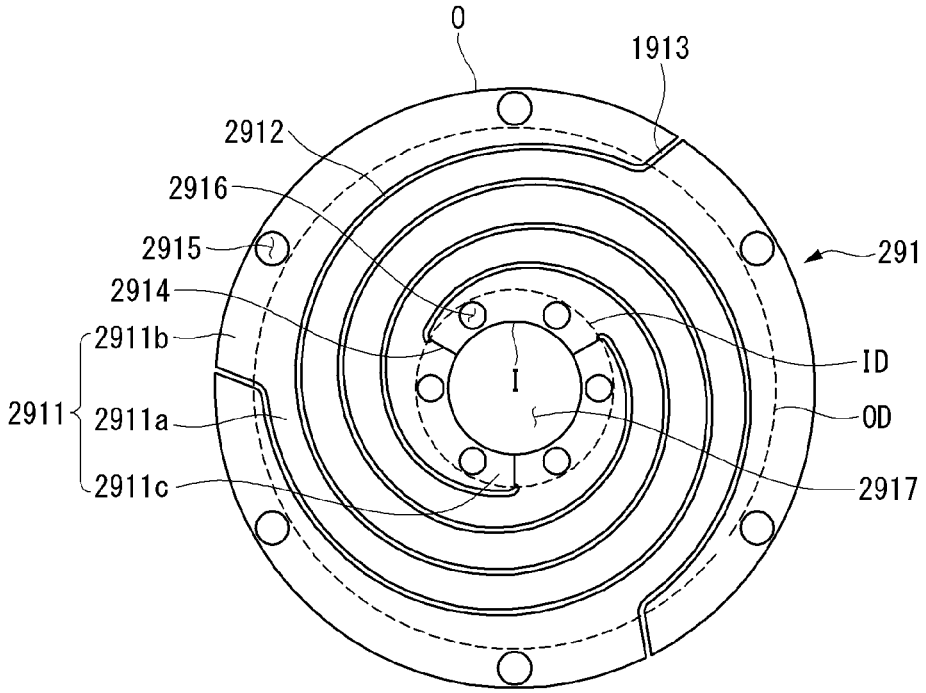
FIG. 11 is a front view of an elastic body in accordance with a fifth embodiment of the present disclosure.
Figure 12:
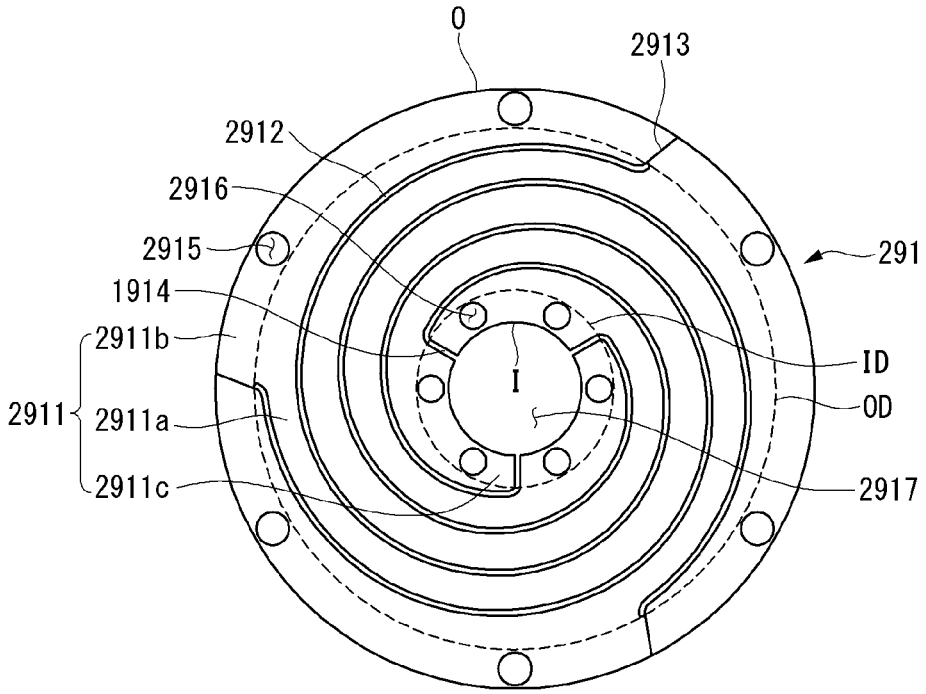
FIG. 12 is a front view of an elastic body in accordance with a sixth embodiment of the present disclosure.

FIG. 9 illustrates an elastic body 291 in accordance with a third embodiment of the present disclosure in a front view and a partial perspective view. FIG. 10 illustrates an elastic body 291 in accordance with a fourth embodiment of the present disclosure in a front view and a partial perspective view. FIG. 11 is a front view of an elastic body 291 in accordance with a fifth embodiment of the present disclosure. FIG. 12 is a front view of an elastic body 291 in accordance with a sixth embodiment of the present disclosure.

The detailed configuration of the elastic body 291 and the linear compressor 100 including the elastic body of the present disclosure according to FIGS. 9 to 12, which will not be described below, may be understood to be the same as the detailed configuration of the elastic body 191 and the linear compressor 100 including the elastic body in accordance with the first and/or second embodiment(s) of the present disclosure according to FIGS. 2 to 8.

Referring to FIGS. 9 and 10, outer portions 2911*b* of a plurality of elastic units 2911 may come into contact with each other. Here, an outer contact portion 2913 may be formed on a portion where the outer portions 2911*b* come into contact with each other. Specifically, the clockwise end of the outer portion 2911*b* may be in contact with the counterclockwise end of the outer portion 2911*b* of an adjacent elastic unit 2911 in a clockwise direction. When the outer portions 2911*b* come into contact with each other in a circumferential direction, it may be easy to align the plurality of elastic units 2911 on the basis of the outer portions 2911*b*, and a manufacturing time may be shortened. Furthermore, since the vibration of each elastic unit 2911 may be offset by an adjacent outer portion 2911*b* when the linear compressor 100 is operated, it may be advantageous in terms of durability and reduction in noise.

The outer end of a slit 2912 may be bent outwards in a radial direction. Specifically, the outer end of the slit 2912 may be bent outwards in the radial direction in a curved shape, or be bent while making an angle.

If the slit 2912 is spirally formed and outer portions 2911*b* which are immediately adjacent to each other at an outer end of the spiral come into contact with each other, interference may occur between the outer portions 2911*b* which are adjacent at the outer contact portion 2913, when the linear compressor 100 is operated. The interference may cause the abrasion of the outer portion 2911*b* as well as noise. Here, if a portion which is bent radially outwards from the outer end of the slit 2912 is formed, this may minimize the interference.

Referring to FIG. 9, when viewed from the axial direction, the outer contact portion 2913 may extend along the outer edge of the spiral formed by the slit 2912 in the radial direction. Otherwise, referring to FIG. 10, when viewed from the axial direction, the outer contact portion 2913 may extend along the inner edge of the spiral formed by the slit 2912 in the radial direction. Thus, when the outer contact portion 2913 is formed along any one of both edges of the slit 2912, the shape of the outer portions of the plurality of elastic units 2911 may be simplified, thus making it easy to manufacture the plurality of elastic units 2911.

Referring to FIGS. 9 and 10, inner portions 2911*c* of the plurality of elastic units 2911 may come into contact with each other. Here, an inner contact portion 2914 may be formed on a portion where the inner portions 2911*c* come into contact with each other. Specifically, the clockwise end of the inner portion 2911*c* may be in contact with the counterclockwise end of the inner portion 2911*c* of an adjacent elastic unit 2911 in a clockwise direction. When the inner portions 2911*c* come into contact with each other in a circumferential direction, it may be easy to align the plurality of elastic units 2911 on the basis of the inner portions 2911*c*, and a manufacturing time may be shortened. Furthermore, since the vibration of each elastic unit 2911 may be offset by an adjacent outer portion 2911*b* when the linear compressor 100 is operated, it may be advantageous in terms of durability and reduction in noise.

The inner end of a slit 2912 may be bent inwards in a radial direction of a spiral travel direction of a spiral formed by the slit 2912. Specifically, the inner end of the slit 2912 may be bent in a curved shape inwards in the radial direction of the spiral travel direction of the spiral formed by the slit 2912, or be bent while making an angle.

If the slit 2912 is spirally formed and outer portions 2911*b* which are immediately adjacent to each other at an outer end of the spiral come into contact with each other, interference may occur between the inner portions 2911*c* which are adjacent at the inner contact portion 2914, when the linear compressor 100 is operated. The interference may cause the abrasion of the inner portion 2911*c* as well as noise. Here, if a portion which is bent at the inner portion of the slit 2912 is formed, this may minimize the interference.

Referring to FIG. 9, when viewed from the axial direction, the inner contact portion 2914 may extend along the inner edge of the spiral formed by the slit 2912 in the radial direction. Otherwise, referring to FIG. 10, when viewed from the axial direction, the inner contact portion 2914 may extend along the outer edge of the spiral formed by the slit 2912 in the radial direction. Thus, when the inner contact portion 2914 is formed along any one of both edges of the slit 2912, the shape of the outer portions of the plurality of elastic units 2911 may be simplified, thus making it easy to manufacture the plurality of elastic units 2911.

Referring to FIG. 11, the outer portions 2911*b* may be spaced apart from each other as in the elastic body 291 according to the first embodiment of the present disclosure, and the inner portions 2911*c* may come into contact with each other as in the elastic body 291 according to the third embodiment of the present disclosure.

Furthermore, referring to FIG. 12, the outer portions 2911*b* may come into contact with each other as in the elastic body 291 according to the third embodiment of the present disclosure, and the inner portions 2911*c* may be spaced apart from each other as in the elastic body 291 according to the first embodiment of the present disclosure.

As shown in FIG. 11 and/or FIG. 12, if the alignment of either of the outer portions 2911*b* or the inner portions 2911*c* in the plurality of elastic units 2911 is precise, a remaining one may be automatically aligned. For example, if the outer portions 2911*b* are aligned to be in contact with each other, the inner portions 2911*c* may not come into contact with each other. As described about the elastic body 291 according to the first embodiment of the present disclosure with reference to FIG. 6, an inner boundary portion 1914 may be formed between the inner portions 2911*c*. When the inner boundary portion 1914 is connected to the inner end of the slit 2912, a laser cutting process may be more easily performed. The same applies to a case where the inner portions 2911*c* are aligned to come into contact with each other and the outer portions 2911*b* are not in contact with each other.

Figure 13:
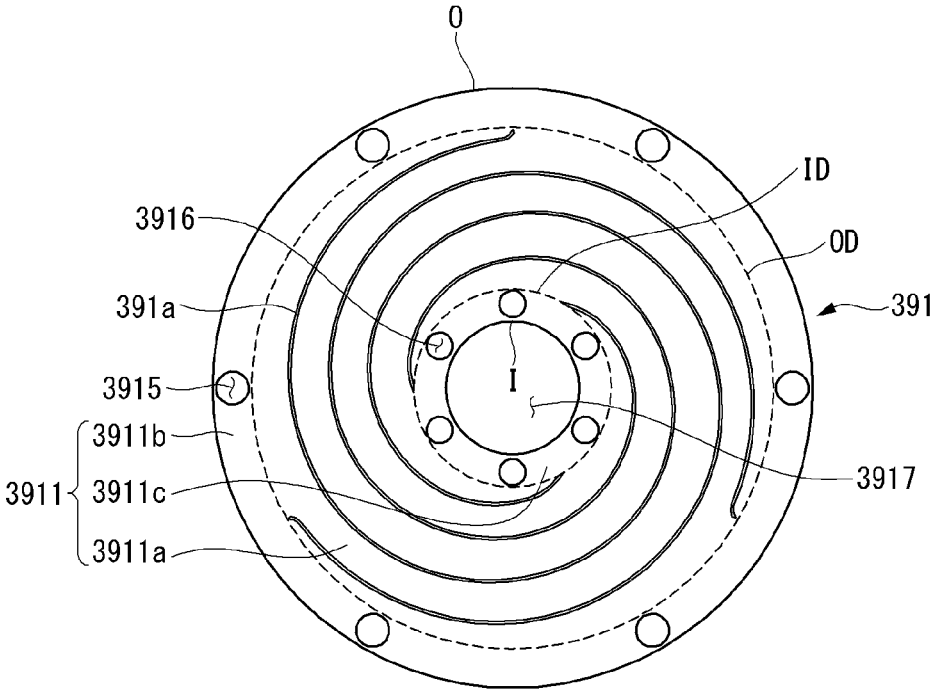
FIG. 13 is a front view of an elastic body in accordance with a seventh embodiment of the present disclosure.

FIG. 13 is a front view of an elastic body 391 in accordance with a seventh embodiment of the present disclosure.

The detailed configuration of the elastic body 391 and the linear compressor 100 including the elastic body in accordance with the seventh embodiment of the present disclosure according to FIG. 13, which will not be described below, may be understood to be the same as the detailed configuration of the elastic body 191 and the linear compressor 100 including the elastic body in accordance with the first and/or second embodiment(s) of the present disclosure according to FIGS. 2 to 8.

Referring to FIG. 13, the elastic body 391 in accordance with the seventh embodiment of the present disclosure may be configured such that an outer portion 3911*b* and an inner portion 3911*c* are integrally formed in a circumferential direction. That is, it is to be understood that the elastic body 391 in accordance with the seventh embodiment of the present disclosure is manufactured not by forming a plurality of elastic units 3911 but by forming a spiral slit 3912 on one disc.

Similarly to the elastic bodies 191 and 291 according to the first to sixth embodiments of the present disclosure, the width of the slit 3912 of the elastic body 391 in accordance with the seventh embodiment of the present disclosure may be formed to be 1.5 times as small as the thickness d1 of the elastic body.

In the elastic body 391 in accordance with the seventh embodiment of the present disclosure, the slit 3912 may be formed thin regardless of the thickness of the elastic body, thus allowing the elastic body 391 of a desired rigidity (N/m) to be freely formed. Furthermore, since the slit 3912 is formed by radiating laser onto one disc, the process of aligning the plurality of elastic units 3911 is not required unlike the elastic bodies 191 and 291 according to the first to sixth embodiments of the present disclosure, thus enabling an easy manufacturing process.

When the elastic body 391 in accordance with the seventh embodiment of the present disclosure is manufactured, there is a limit to make the width d2 of the slit 1912 thin through a punching process. Thus, it may be preferable to use a laser cutting process where laser is radiated onto one disc along the shape of the slit 3912.

The laser cutting process is a method of cutting a metal plate by radiating laser onto the metal plate. Here, a cutting width and a cutting depth may be adjusted by adjusting the intensity of the laser and a speed at which a laser pointer moves.

For example, if the intensity of the laser is too high, the cutting speed may increase, but the cutting width may increase. In detail, the cutting width of a surface which is in direct contact with the laser may be wide, while the cutting width of an opposite surface may be narrow. Thus, the cutting portion is formed in a 'V' shape when seen in a sectional view. In this case, since the width of the cutting portion is not constant, manufacturing tolerance may increase. In contrast, if the intensity of the laser is too low, the width of the cutting portion may decrease and the width of the cutting portion may be constant, but the cutting speed may decrease. Therefore, it may be important to set a proper level of laser intensity and cutting speed in the laser cutting technology.

When the elastic body is manufactured using the laser cutting method, it may be made at once by stacking several metal plates. Thereby, it is possible to maximize process efficiency. Specifically, if the speed of the laser pointer decreases, the cutting depth may increase. In this case, as described above, if the intensity of the laser pointer is high, the cutting width of a metal plate located at an upper position may be larger than that of a metal plate located at a lower position, so that it may be preferable to radiate laser having a relatively low intensity and decrease the speed of the laser pointer.

Figure 14:
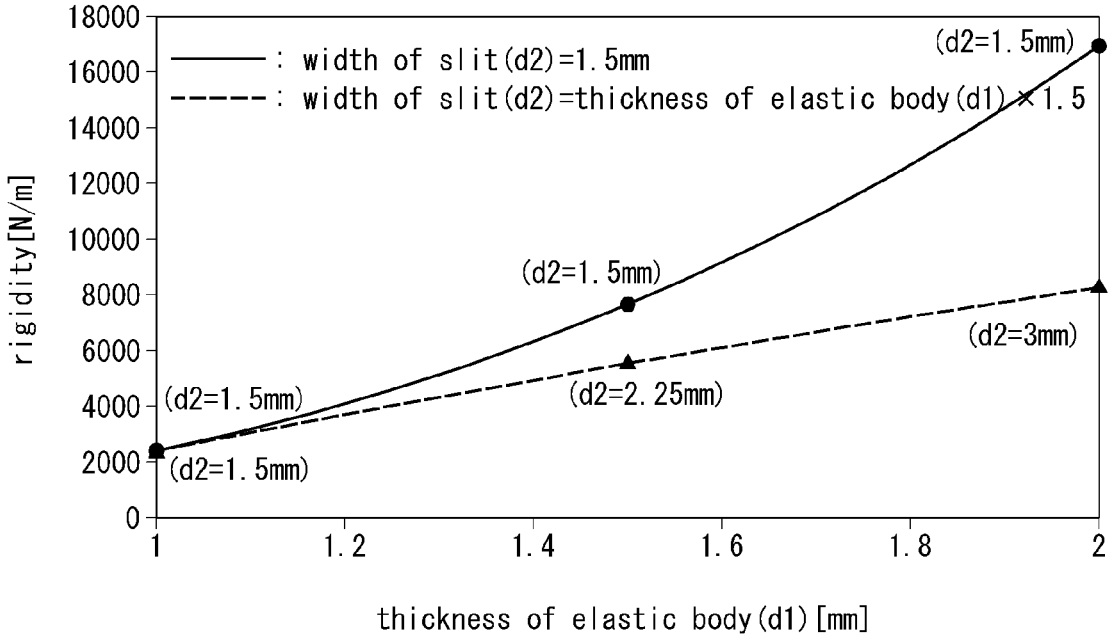
FIG. 14 is a graph showing rigidity (N/m) for width of a slit as the thickness of each of the elastic body in accordance with an embodiment of the present disclosure and a conventional elastic body increases.

FIG. 14 is a graph showing rigidity (N/m) for width d2 of the slit 1912 as the thickness d1 of each of the elastic body 191 in accordance with the first embodiment of the present disclosure and the conventional elastic body increases.

Referring to FIG. 14, an x-axis represents the elastic-body thickness d1, and a y-axis represents the rigidity (N/m) of the elastic body 191. A solid line shows the rigidity (N/m) as the thickness of the elastic body 191 in accordance with the present disclosure increases, while a dotted line shows the rigidity (N/m) as the thickness of the conventional elastic body 191 increases.

It is to be understood that the rigidity (N/m) represents a ratio of elastic force to displacement, and the rigidity is an elastic modulus or a spring constant. Generally, the rigidity of the plate spring is proportional to the square of the plate thickness.

In order to prevent a punching machine from being damaged, the conventional elastic body 191 should be configured such that the width d2 of the slit 1912 is 1.5 times as large as the elastic-body thickness d1. Therefore, referring to the dotted line of FIG. 14, when the elastic-body thickness d1 is 1 mm, 1.5 mm, and 2 mm, the width d2 of the formed slit 1912 is at least 1.5 mm, 2.25 mm, and 3 m. The dotted line of FIG. 14 is the dotted line connecting points showing the rigidity (N/m) of each case.

In the dotted line of FIG. 14, as the elastic-body thickness d1 increases, the increase rate of the rigidity (N/m) decreases. That is, the increase rate of the rigidity (N/m) of the elastic body 191 has a negative value as the elastic-body thickness d1 increases. As the elastic-body thickness d1 increases, the width d2 of the slit 1912 also increases. Thus, a portion lost in the metal plate increases. Therefore, it can be seen that an increase in rigidity (N/m) as the elastic-body thickness d1 increases has limitation.

In contrast, in the elastic body 191 according to the present disclosure, when the elastic-body thickness d1 increases, the width d2 of the slit 1912 is constant, and the increase rate of the rigidity (N/m) of the elastic body 191 has a positive value as the elastic-body thickness d1 increases. That is, the graph of FIG. 14 shown by the solid line may be convex downwards. Moreover, the rigidity (N/m) of the elastic body 191 may be proportional to the square of the elastic-body thickness d1.

Specifically, referring to the solid line of FIG. 14, the elastic body 191 according to the present disclosure may be configured such that the width d2 of the slit 1912 is kept constant regardless of a change in elastic-body thickness d1. By way of example, the solid line of FIG. 14 shows the rigidity (N/m) according to a change in thickness of the elastic body 191, when the width d2 of the slit 1912 has a constant value of 1.5 mm. Since the elastic body 191 according to the present disclosure has no lost portion for forming the slit 1912 even if the elastic-body thickness d1 increases, the rigidity (N/m) may increase in proportion to the square of the elastic-body thickness d1, when the elastic-body thickness d1 increases. That is, the rigidity (N/m) may increase in the form of a quadratic curve as the elastic-body thickness d1 increases.

Referring to FIG. 14, it can be seen that the rigidity (N/m) of the elastic body 191 according to the first embodiment of the present disclosure is about twice as large as the rigidity (N/m) of the conventional elastic body, when the elastic-body thickness d1 is 2 mm. That is, when the elastic-body thickness d1 is 2 mm or more, the elastic body 191 according to the first embodiment of the present disclosure may have a greater effect, compared to the conventional elastic body. Therefore, the elastic-body thickness d1 may be preferably 2 mm or more, for example.

Figure 15:
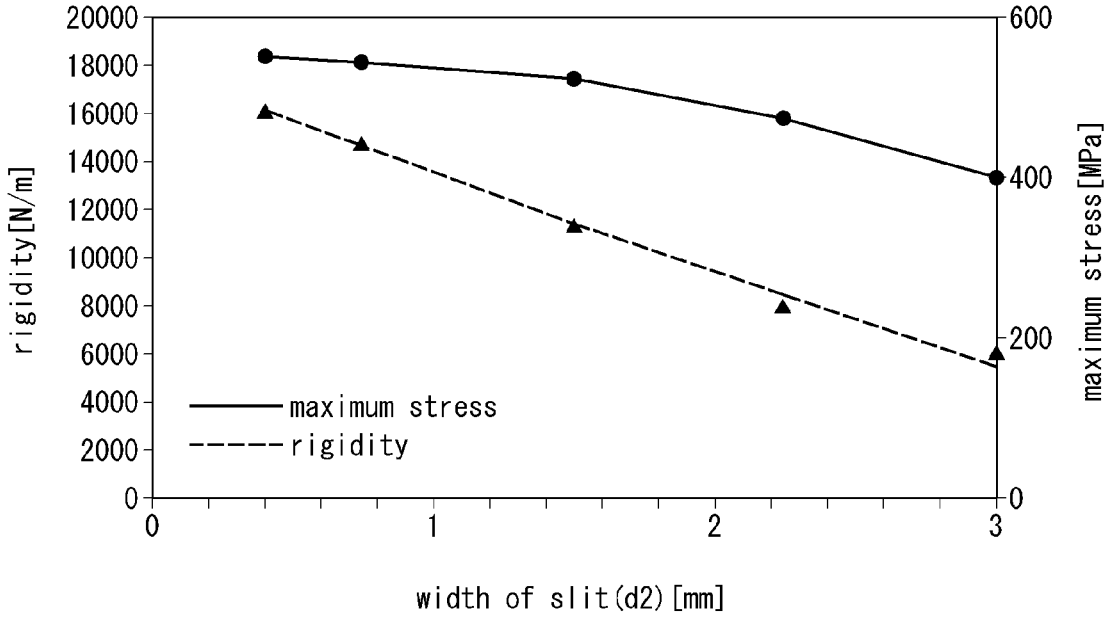
FIG. 15 is a graph showing rigidity (N/m) and maximum stress (MPa) for a width of a slit, when the thickness of the elastic body in accordance with an embodiment of the present disclosure is 2 mm.

FIG. 15 is a graph showing rigidity (N/m) and maximum stress (MPa) for the width of the slit, when the thickness d1 of the elastic body 191 in accordance with the first embodiment of the present disclosure is 2 mm.

Referring to FIG. 15, an x-axis represents the width d2 of the slit 1912, a left y-axis represents the rigidity (N/m) of the elastic body 191, and a right y-axis represents maximum stress (MPa) of a portion of the elastic body 191 on which the largest stress acts. The solid line of FIG. 15 shows the maximum stress (MPa) of the elastic body as the function of the width d2 of the slit 1912, and the dotted line of FIG. 15 shows the rigidity (N/m) of the elastic body as the function of the width d2 of the slit 1912. Here, the maximum stress (MPa) means the elastic force applied to the elastic body 191 per unit area in the portion of the elastic body 191 on which the largest stress acts.

Referring to the dotted line of FIG. 15, as the width d2 of the slit 1912 decreases, the rigidity (N/m) may be increased at a constant rate. As the rigidity (N/m) increases, the performance of the elastic body 191 may be improved.

Referring to the solid line of FIG. 15, as the width d2 of the slit 1912 decreases, the maximum stress MPa may increase. In contrast, as the width d2 of the slit 1912 decreases, the width of the elastic portion 1911*a* increases, and consequently the durability of the elastic body may also be improved. Therefore, it is to be understood that, when the width d2 of the slit 1912 decreases, the elastic body 191 having the increase rate of the maximum stress (MPa) smaller than the increase rate of the rigidity (N/m) exhibits good performance.

Referring to the solid line of FIG. 15, it can be seen that the increase rate of the maximum stress (MPa) is significantly reduced as the width d2 of the slit 1912 decreases in a section where the width d2 of the slit 1912 is about 1.5 mm or less. Therefore, the width d2 of the slit 1912 may be preferably 1.5 mm or less.

Meanwhile, if the width d2 of the slit 1912 is less than 1.5 mm, when the piston 150 axially reciprocates, interference may occur between the elastic portions 1911*a*. Furthermore, in the case of forming the plurality of elastic units 1911 using the laser cutting process, manufacturing tolerance corresponding to the width of a laser beam may be required between the elastic units 1911. Therefore, the width d2 of the slit 1912 may be preferably 0.5 mm or more.

Figure 16:
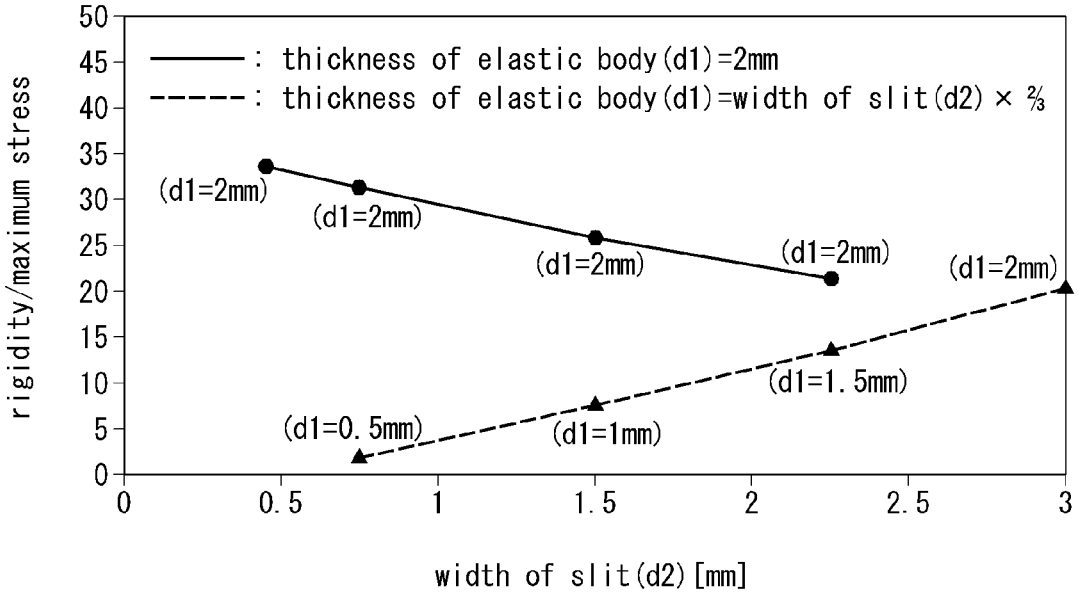
FIG. 16 is a graph showing a ratio of rigidity (N/m) to maximum stress (MPa) for the thickness of the elastic body as the width of the slit of each of the elastic body in accordance with an embodiment of the present disclosure and a conventional elastic body increases.

FIG. 16 is a graph showing a ratio of rigidity (N/m) to maximum stress (MPa) for the thickness d1 of the elastic body as the width d2 of the slit 1912 of each of the elastic body 191 in accordance with the first embodiment of the present disclosure and the conventional elastic body 191 increases.

Referring to FIG. 16, an x-axis represents the width d2 of the slit 1912, and a y-axis represents the ratio of rigidity (N/m) to maximum stress (MPa) of the elastic body 191. The solid line shows a ratio of rigidity (N/m) to stress (MPa) as the width d2 of the slit 1912 of the elastic body 191 in accordance with the present disclosure decreases, while the dotted line shows a ratio of rigidity (N/m) to maximum stress (MPa) as the thickness of the conventional elastic body 191 decreases When the width of the slit 1912 decreases, the increase rate of the maximum stress (MPa) is small. As the rigidity (N/m) increases, the performance of the elastic body 191 may be improved. Therefore, when the width d2 of the slit 1912 decreases, the larger a rigidity/maximum stress value is, the better the performance of the elastic body 191 is.

As described above, the minimum value of the width d2 of the slit 1912 of the conventional elastic body 191 should be 1.5 times as large as the elastic-body thickness d1. In other words, the maximum value of the elastic body thickness d1 should be ⅔ times as small as the width d2 of the slit 1912. Therefore, referring to the dotted line of FIG. 16, when the width d2 of the slit 1912 is 0.75 mm, 1.5 mm, 2.25 mm, and 3 mm, the thickness d1 of the formed elastic body is at most 0.5 mm, 1 mm, 1.5 mm, and 2 mm. The dotted line of FIG. 16 is the dotted line connecting points showing rigidity/maximum stress of each case.

In the dotted line of FIG. 16, as the width d2 of the slit 1912 decreases, the rigidity/maximum stress decreases. This means that, as the width d2 of the slit 1912 decreases, the elastic-body thickness d1 also decreases, so that the rigidity (N/m) is inevitably reduced.

Meanwhile, in the elastic body 191 in accordance with the present disclosure, the elastic-body thickness d1 may be kept constant regardless of a change in width d2 of the slit 1912. The solid line of FIG. 16 shows the rigidity/maximum stress according to a change in width d2 of the slit 1912, when the elastic-body thickness d1 has a constant value of 2 mm, for example.

Referring to the solid line of FIG. 16, as described above with reference to FIG. 15, in the elastic body 191 according to the first embodiment of the present disclosure, when the width d2 of the slit 1912 decreases, the increase rate of the maximum stress MPa is smaller than the increase rate of the rigidity (N/m). Therefore, it can be seen from the solid line of FIG. 16 that, as the width d2 of the slit 1912 decreases, the rigidity/maximum stress increases.

Figure 17:
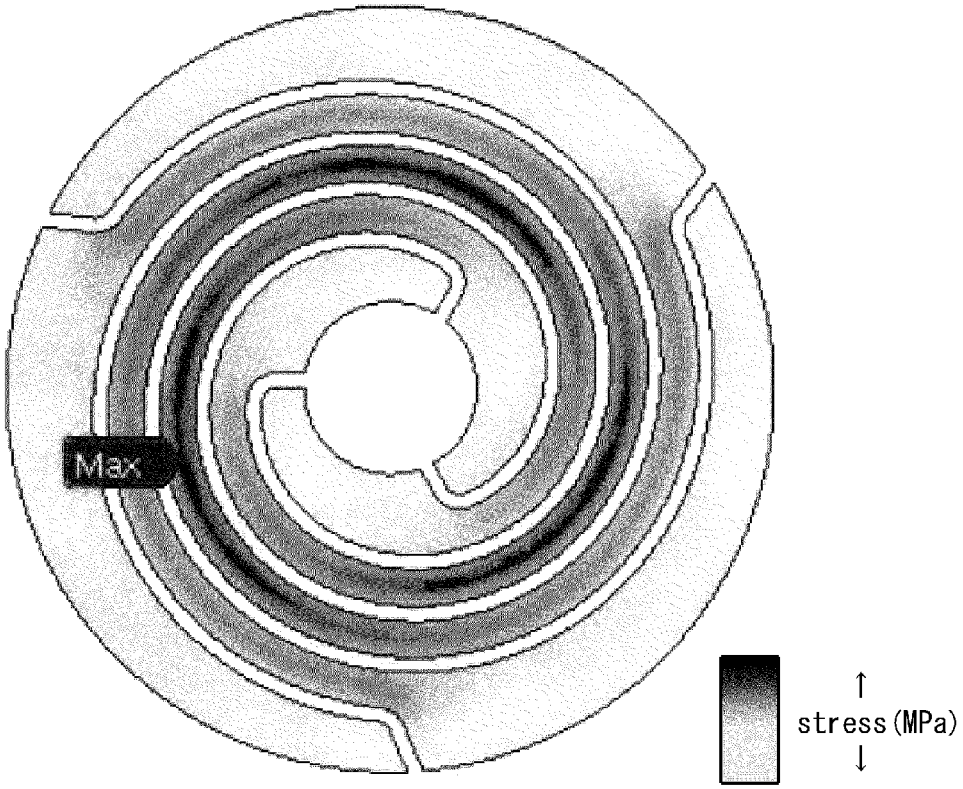
FIG. 17 shows stress (MPa) at a maximum amplitude of the elastic body in accordance with the first to sixth embodiments of the present disclosure.
Figure 18:
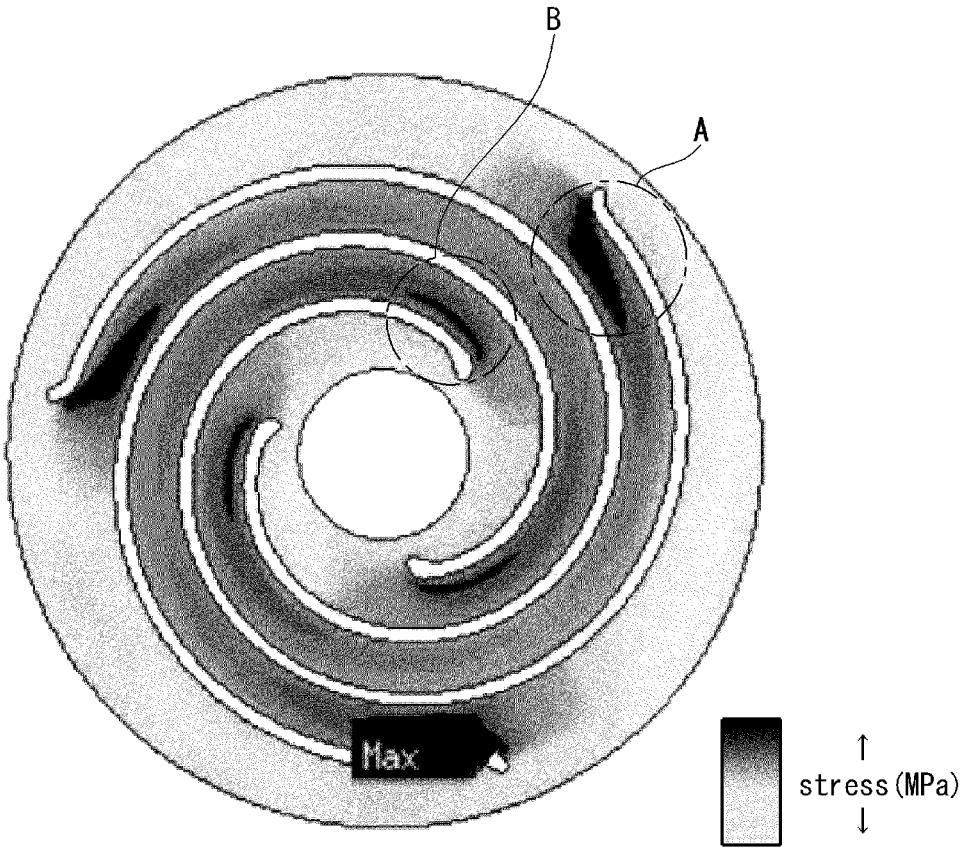
FIG. 18 shows stress (MPa) at a maximum amplitude of the conventional elastic body.

FIG. 17 shows stress (MPa) at a maximum amplitude of the elastic bodies 191 and 291 in accordance with the first to sixth embodiments of the present disclosure. FIG. 18 shows stress (MPa) at a maximum amplitude of the conventional elastic body 191.

In FIGS. 17 and 18, the darker the color of shade is, the more the stress (MPa) acts.

Referring to FIG. 18, it can be seen that, when the elastic body 191 is formed of one plate, the most stress (MPa) concentrates on the outer portion A and the inner portion B of the elastic portion 1911*a*. Specifically, the outer circumference is coupled to a stator such as the outer stator 131, and the inner circumference is coupled to the piston 15, and the elastic portion is bent, thus generating an elastic force. In this case, it is to be understood that the most bending moment is generated in the outer portion A of the elastic portion that is a connecting point between the outer portion and the elastic portion, and the inner portion B of the elastic portion that is a connecting point between the inner portion and the elastic portion, so that stress (MPa) concentrates on the outer portion A of the elastic portion and the inner portion B of the elastic portion. As such, if stress (MPa) concentrates on any one portion, it causes damage and consequently the durability and reliability of the elastic body 191 may be deteriorated.

However, referring to FIG. 17, the elastic bodies 191 and 291 in accordance with the first to sixth embodiments of the present disclosure may be configured such that the plurality of elastic units 1911 and 2911 is formed, and the outer portion 1911*b* or 2911*b* and/or the inner portion 1911*c* or 2911*c* is individually formed on each of the elastic portions 1911*a* and 2911*a*. That is, the outer portions 1911*b* and 2911*b* may be separated from each other, and the inner portions 1911*c* and 2911*c* may also be separated from each other. Therefore, even if the elastic portions 1911*a* and 2911*a* are bent, the bending moment may be alleviated to some extent, so that the stress (MPa) may be distributed throughout the elastic portions 1911*a* and 2911*a*. Referring to FIG. 17, it can be seen that stress (MPa) is distributed throughout a spiral arm of each of the elastic portions 1911*a* and 2911*a*. As such, when the elastic bodies 191 and 291 are formed of the plurality of elastic units 1911 and 2911, the concentration of the stress (MPa) may be alleviated, and thereby the durability and the reliability of the elastic bodies 191 and 291 may be improved.

Some embodiments or other embodiments of the disclosure described above are not exclusive or distinct from each other. Some embodiments or other embodiments of the disclosure described above can be used together or combined in configuration or function.

For example, a configuration "A" described in an embodiment and/or the drawings and a configuration "B" described in another embodiment and/or the drawings can be combined with each other. That is, although the combination between the configurations is not directly described, the combination is possible except if it is described that the combination is impossible.

The above detailed description is merely an example and is not to be considered as limiting the present disclosure. The scope of the present disclosure should be determined by rational interpretation of the appended claims, and all variations within the equivalent scope of the present disclosure are included in the scope of the present disclosure.

What is claimed is:

1. An elastic body, comprising:

a plurality of elastic plates that are disposed about an axis and surround the axis in a circumferential direction, the plurality of elastic plates facing one another in a radial direction and defining a slit radially between adjacent elastic plates among the plurality of elastic plates, wherein the plurality of elastic plates are spaced apart from one another, wherein each of the plurality of elastic plates comprises:

an elastic portion that spirally extends about the axis and away from the axis in the radial direction, an outer portion disposed at an outside of the elastic portion in the radial direction, and an inner portion disposed at an inside of the elastic portion in the radial direction, wherein the outer portions of the plurality of elastic plates are disconnected from one another, and the inner portions of the plurality of elastic plates are disconnected from one another, wherein the outer portion of a first elastic plate among the plurality of elastic plates is disposed adjacent to the outer portion of a second elastic plate among the plurality of elastic plates, wherein the inner portion of the first elastic plate is disposed adjacent to the inner portion of the second elastic plate, wherein the plurality of elastic plates define an outer boundary portion between the outer portion of the first elastic plate and the outer portion of the second elastic plate, and wherein a width of the outer boundary portion is equal to a width of the slit.

2. The elastic body of claim 1, wherein a width of the slit is constant along the plurality of elastic plates, wherein a rigidity (N/m) of the elastic body is defined by a ratio of a force applied to the elastic body with respect to a displacement of the elastic body by the force, and wherein the rigidity of the elastic body increases based on an increase of a thickness of the elastic body in an axial direction, an increase rate of the rigidity of the elastic body having a positive value such that the increase rate of the rigidity of the elastic body increases based on the increase of the thickness of the elastic body.

3. The elastic body of claim 1, wherein a width of the slit is constant along the plurality of elastic plates, wherein a rigidity (N/m) of the elastic body is defined by a ratio of a force applied to the elastic body with respect to a displacement of the elastic body by the force, and wherein the rigidity of the elastic body increases based on an increase of a thickness of the elastic body and is proportional to a square of the thickness of the elastic body.

4. The elastic body of claim 1, wherein the outer portion of each of the plurality of elastic plates has a clockwise end and a counterclockwise end, wherein the first elastic plate and the second elastic plate are arranged adjacent to each other along a clockwise direction about the axis, the clockwise end of the first elastic plate facing the counterclockwise end of the second elastic plate, and wherein a shape of the clockwise end of the first elastic plate corresponds to a shape of the counterclockwise end of the second elastic plate.

5. The elastic body of claim 4, wherein the outer boundary portion extends outward from an outer end of the slit in the radial direction.

6. The elastic body of claim 1, wherein the inner portion of each of the plurality of elastic plates has a clockwise end and a counterclockwise end, wherein the first elastic plate and the second elastic plate are arranged adjacent to each other along a clockwise direction about the axis, the clockwise end of the first elastic plate facing the counterclockwise end of the second elastic plate, and wherein a shape of the clockwise end of the first elastic plate corresponds to a shape of the counterclockwise end of the second elastic plate.

7. The elastic body of claim 6, wherein the slit extends along a spiral travel direction and has an inner end that faces the axis and an outer end that is disposed outward relative to the inner end in the radial direction, wherein the plurality of elastic plates define an inner boundary portion between the inner portion of the first elastic plate and the inner portion of the second elastic plate, the inner boundary portion extending from the inner end of the slit toward the axis in the radial direction.

8. The elastic body of claim 6, wherein the plurality of elastic plates define an inner boundary portion between the inner portion of the first elastic plate and the inner portion of the second elastic plate, and wherein a width of the inner boundary portion is equal to a width of the slit.

9. The elastic body of claim 1, wherein an outer end of the slit is bent outwards in the radial direction.

10. The elastic body of claim 1, wherein the slit extends along a spiral travel direction and has an inner end that faces the axis and an outer end that is disposed outward relative to the inner end in the radial direction, and wherein the inner end of the slit is bent toward the axis in the radial direction.

11. The elastic body of claim 1, wherein the plurality of elastic plates comprise three elastic plates, wherein outer edges of the outer portions of the three elastic plates define an outer circumference of the elastic body, wherein inner edges of the inner portions of the three elastic plates define an inner circumference of the elastic body, and wherein a shape of each of the three elastic plates corresponds to a shape of a space defined between two of the three elastic plates, the outer circumference, and the inner circumference.

12. The elastic body of claim 1, wherein the outer portion of each of the plurality of elastic plates has a clockwise end and a counterclockwise end, wherein each of the plurality of elastic plates defines a plurality of outer coupling holes that are arranged circumferentially in the outer portion, and wherein the plurality of outer coupling holes comprise:

a first outer coupling hole defined at a position closer to the clockwise end of the outer portion than to the counterclockwise end of the outer portion, and a second outer coupling hole defined at a position closer to the counterclockwise end of the outer portion than to the clockwise end of the outer portion.

13. The elastic body of claim 1, wherein the inner portion of each of the plurality of elastic plates has a clockwise end and a counterclockwise end, wherein each of the plurality of elastic plates defines a plurality of inner coupling holes that are arranged circumferentially on the inner portion, and wherein the plurality of inner coupling holes comprise:

a first inner coupling hole defined at a position closer to the clockwise end of the inner portion and to the counterclockwise end of the outer portion, and a second inner coupling hole defined at a position closer to the counterclockwise end of the outer portion than to the clockwise end of the inner portion.

14. A linear compressor, comprising:

the elastic body of claim 1;

a cylinder;

a piston disposed in the cylinder and configured to reciprocate along the axis;

a driver disposed at an outside of the cylinder in the radial direction, wherein the elastic body is disposed rearward relative to the cylinder and the driver in an axial direction; and a connector that connects the piston to the elastic body.

15. The linear compressor of claim 14, wherein the connector comprises:

a connecting plate disposed forward relative to the inner portion of each of the plurality of elastic plates in the axial direction and fixed to the inner portion of each of the plurality of elastic plates; and a rod that couples the piston to the connecting plate, the rod having a first end connected to the piston and a second end connected to a central area of the connecting plate adjacent to the axis.

16. The linear compressor of claim 15, wherein the connecting plate comprises:

a ring portion that overlaps with a front side of the inner portion in the axial direction and extends in the circumferential direction; and a plurality of ribs that connect the second end of the rod to the ring portion, wherein a number of the plurality of ribs is equal to a number of the plurality of elastic plates, and wherein an outer end of each of the plurality of ribs is connected to the ring portion and disposed in a central region defined by the inner portions of the plurality of elastic plates.

17. The linear compressor of claim 14, further comprising:

a fixing member disposed between the driver and the outer portions and fixed to the outer portions, the fixing member extending in the circumferential direction.

* * * * *